US009393484B2

(12) United States Patent
Kanekal

(10) Patent No.: US 9,393,484 B2
(45) Date of Patent: Jul. 19, 2016

(54) ELECTRONIC TRADING CARD AND GAME SYSTEM

(71) Applicant: Hemanth Gundurao Kanekal, Cupertino, CA (US)

(72) Inventor: Hemanth Gundurao Kanekal, Cupertino, CA (US)

( * ) Notice: Subject to any disclaimer, the term of this patent is extended or adjusted under 35 U.S.C. 154(b) by 31 days.

(21) Appl. No.: 14/080,788

(22) Filed: Nov. 14, 2013

(65) Prior Publication Data

US 2014/0073392 A1 Mar. 13, 2014

Related U.S. Application Data

(62) Division of application No. 12/412,055, filed on Mar. 26, 2009, now Pat. No. 8,608,573.

(60) Provisional application No. 61/072,260, filed on Mar. 29, 2008.

(51) Int. Cl.
*A63F 1/04* (2006.01)
*A63F 9/24* (2006.01)

(52) U.S. Cl.
CPC ..... *A63F 1/04* (2013.01); *A63F 2009/2488* (2013.01)

(58) Field of Classification Search
None
See application file for complete search history.

(56) References Cited

U.S. PATENT DOCUMENTS 5,144,104 A 9/1992 Bedoya
5,533,124 A 7/1996 Smith et al.
5,629,503 A 5/1997 Tomahsen
5,738,583 A 4/1998 Comas et al.
5,743,801 A 4/1998 Welander
6,042,150 A 3/2000 Daley
6,162,122 A 12/2000 Acres et al.
6,200,216 B1 3/2001 Peppel
6,680,715 B2 1/2004 Blotky et al.
6,688,973 B2 2/2004 Satloff et al.
6,745,236 B1 6/2004 Hawkins et al.
6,761,637 B2 7/2004 Weston et al.
6,773,351 B2 8/2004 Brown
6,869,699 B2 3/2005 Klubek
7,334,735 B1 2/2008 Antebi
2002/0015027 A1 2/2002 Lee et al.
2002/0052239 A1 5/2002 Finn
2003/0055713 A1 3/2003 Pinto et al.
2004/0063498 A1 4/2004 Oakes et al.
2004/0082383 A1 4/2004 Muncaster et al.
2004/0180712 A1 9/2004 Forman et al.
2004/0244060 A1 12/2004 Glassman et al.

(Continued)

FOREIGN PATENT DOCUMENTS

WO 97/00510 A1 1/1997

OTHER PUBLICATIONS

PCT International Search Report PCT/US2010/028600 Dated Jul. 14, 2010 (4 pages).

*Primary Examiner* — Robert Carpenter
(74) *Attorney, Agent, or Firm* — Minisandram Law Firm; Raghunath S. Minisandram

(57) ABSTRACT

A game system and method for interactive game system is disclosed. The game system includes at least a first trading card and a second trading card. The first trading card and the second trading card include a substrate, a processing engine and a wireless interface configured to detect the presence of the other trading card. The first trading card sends a message to impact the second trading card. A method for interactive game system using first trading card and second trading card is also disclosed.

24 Claims, 17 Drawing Sheets

(56) References Cited

U.S. PATENT DOCUMENTS

| | | | |
|---|---|---|---|
| 2004/0259626 | A1 | 12/2004 | Akram et al. |
| 2005/0058101 | A1 | 3/2005 | Khan |
| 2005/0070358 | A1 | 3/2005 | Angell et al. |
| 2006/0121970 | A1 | 6/2006 | Khal |
| 2007/0060358 | A1 | 3/2007 | Amaitis et al. |
| 2007/0066395 | A1 | 3/2007 | Harris et al. |
| 2007/0093291 | A1 | 4/2007 | Hulvey |
| 2007/0159304 | A1 | 7/2007 | Agarwal et al. |
| 2007/0169165 | A1 | 7/2007 | Crull et al. |
| 2007/0214180 | A1 | 9/2007 | Crawford |
| 2007/0241187 | A1 | 10/2007 | Alderucci et al. |
| 2007/0257101 | A1 | 11/2007 | Alderucci et al. |
| 2008/0005425 | A1 | 1/2008 | Saito |
| 2009/0036188 | A1 | 2/2009 | Gelman |

ELECTRONIC TRADING CARD AND GAME SYSTEM

CROSS REFERENCE TO RELATED APPLICATIONS

This is a divisional application of U.S. patent application Ser. No. 12/412,055, filed on Mar. 26, 2009, entitled "Electronic Trading Card and Game System", which claims priority to U.S. provisional patent application Ser. No. 61/072,260, filed on Mar. 29, 2008, all of which are incorporated herein by reference in their entirety.

TECHNICAL FIELD

The present disclosure generally relates to gaming cards, and more particularly, to wirelessly linked gaming cards.

RELATED ART

The terms "playing card", "trading card" and "gaming cards" are used interchangeably in this disclosure and all these terms refer to one or more articles of a game that represent gaming units of the game. Traditional gaming cards are planar paper or plastic cards with text and images that are specific to the game activities. Text and images in a trading card may provide instructions or describe specific attributes of the gaming card. In some game activities, the gaming cards are exchanged between the players based upon the outcome of the game and/or instructions on the gaming card. The trading cards are used by a player and the game is played by the player, by interacting with other players, game boards and the like. These types of trading cards are generally referred to in this disclosure as passive trading cards. These trading cards lack ability to increase the player experience while playing a game and further require significant interaction and imagination on the part of the players to enjoy a game.

Games are played on hand held devices such as cellular phones, personal digital assistants or similar devices. These games on a hand held device have a data structure associated with the game to represent at different icons and/or different card game like displays on the hand held device. The games implemented in a hand held devices may have different algorithms for different games and may include capability to run other applications like calendar, word processing etc, bringing versatility and general purpose utility to the hand held device, such that the hand held device used for purposes other than game playing alone. Some of the games may also include a central game coordinating computer software on a server that the participant may or may not need to access via the Internet. Although hand held gaming devices may provide enhanced user experience, as compared to a trading card, generally, these gaming devices do not replace the ease of use of trading cards, or the cost of trading cards.

There is a need to enhance the user experience of playing games with trading cards. Handheld gaming devices lack the ease of use and versatility of trading cards. It is in this context that the embodiments of the current disclosure arise.

SUMMARY

In one embodiment, a game system with at least a first trading card and a second trading card is disclosed. The first trading card and the second trading card include a substrate, a processing engine and a wireless interface configured to detect the presence of the other trading card. A plurality of light emitting devices are disposed over the substrate. The first trading card and the second trading card are each configured to detect the presence of the other trading card using the wireless interface. The first trading card initiates a game with the second trading card after detecting the presence of the second trading card and sends a message to impact the second trading card. In some embodiments, a subset of the plurality of light emitting devices is modified to indicate the impact of the message from the first trading card.

In yet another embodiment, a method for interactive game system is disclosed. The method includes providing at least a first trading card and a second trading card. Each trading card is configured to communicate with the other trading card and configured to receive input. The card characteristics of the first trading card and the second trading card are displayed. The first trading card receives input to assemble a message. Then, the first trading card assembles the message to send to the second trading card. Then, the first trading card sends the message to the second trading card to impact the second trading card.

DETAILED DESCRIPTION

In the following detailed description of the present disclosure, numerous specific details are set forth in order to provide a thorough understanding of the present disclosure. However, it will be apparent to one skilled in the art that the present disclosure may be practiced without these specific details. In other instances well-known methods, procedures, components, and circuits have not been described in detail as not to unnecessarily obscure aspects of the present disclosure. Although the following description describes the present disclosure in the context of trading card game with one example game, it should be clear to a person of ordinary skill in the art that the present disclosure can be used in any game systems or game sub systems, or as parts of various games and social networks as well.

The ad-hoc social network, as referenced by the present disclosure is a gathering of participants in an area, such as a mall or a park or in a home, where the wireless trading cards of the participants can communicate with each other. It should be noted that participants in the gathering need not be physically in communication with each other, they may still facilitate the formation of an ad-hoc wireless network, as long as the trading cards are within the range of operation and can communicate effectively.

Also, an ad-hoc wireless social network is possible, for non-game playing purposes, such as participants living in wireless range proximity, utilizing other type of cards that communicate invitations to plural participants for physical proximity socializing. The application of the present disclosure for simple wireless communication, that is of the non gaming type is useful for example, in a community of elderly single adults, who would like to live independently, and yet have a means of creating a physical proximity social situation.

The applications described for the present disclosure, involving ad-hoc wireless networking is by no means limited to the discussions set forth above, and those skilled in the art of social networks may find multiple uses for the present disclosure.

Figure 1:
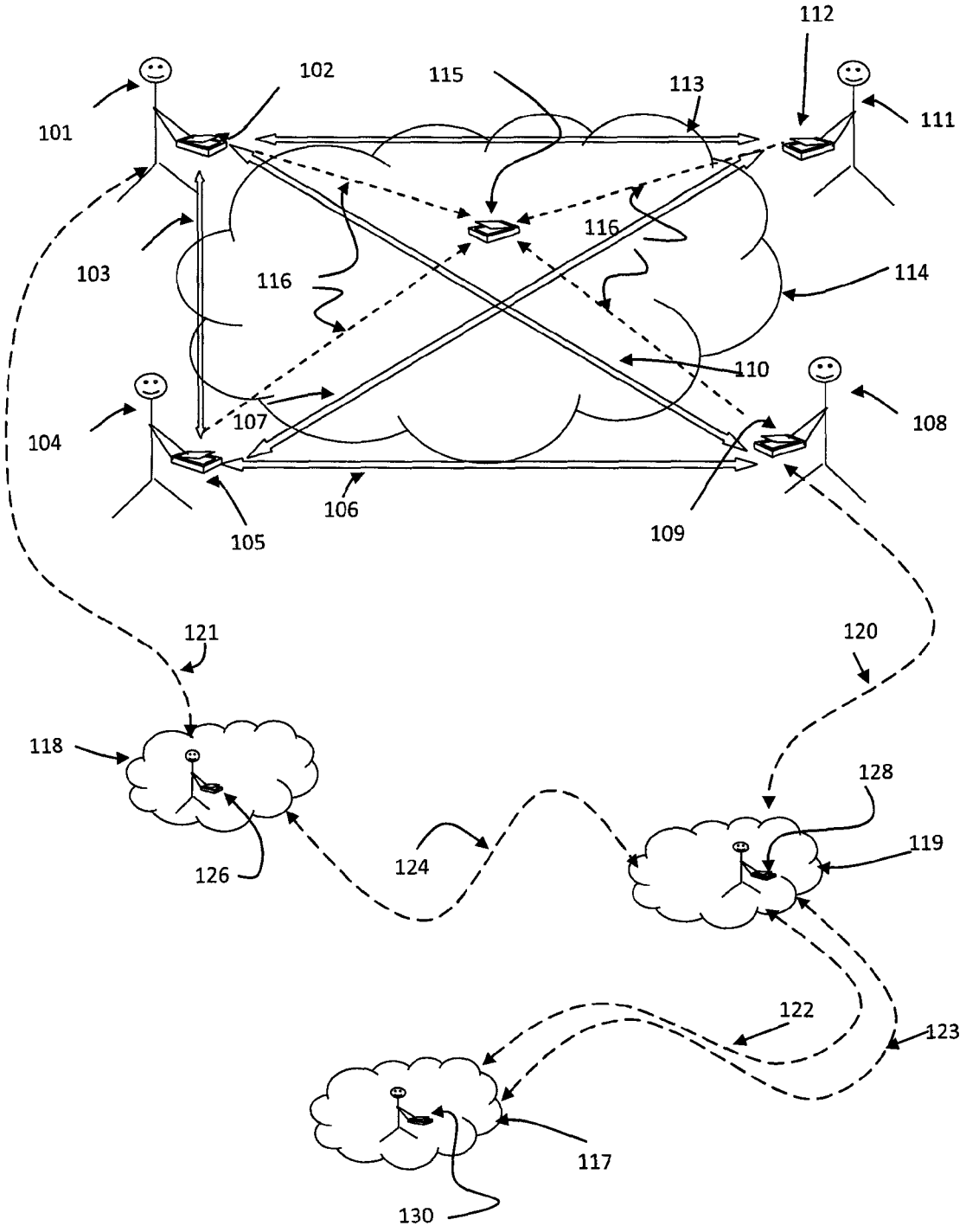
FIG. 1 is a diagram illustrating an exemplary wireless social network of game players with trading cards of the present disclosure.

In accordance with the present disclosure, reference is now made to FIG. 1 illustrating an example of the ad-hoc wireless gaming network. Participants 101, 104, 108 and 111 are shown as an example, though there may be many more in the network. Each of participants 101, 104, 108, 111 holds their trading card 102, 105, 109 and 112 respectively to play the game. A separate or a special purpose trading card, a scorecard 115, is placed within the area of the network. The scorecard 115, may or may not be coupled to a computer system for maintaining the score database, but the scorecard 115, can be used to monitor the game in progress.

Further, as an example, participant 101, and 102, can form a team, while participants 108, and 111 may be individual participants in the game. In such a team to non-team game playing, participants 101, and 104, can communicate with participants 111 and 108. However, as an example, since the participants 108 and 111 are individual players, they may not communicate with each other. The communicability described between the participants 101, 104, 108 and 111 are shown as an example only, since many combinations of such networked communications are possible with a plurality of participants.

The pathways 103, 110, and 113 illustrate the communication pathways between the participant 101 and 104,108, 111, through their respective trading cards 102, 105, 109 and 112 respectively. The communication pathway between trading card 105 of participant 104 and trading card 102 of participant 101 is illustrated by pathway 103. The communication pathway between trading card 109 of participant 108 and trading card 112 of participant 111 is illustrated by pathway 107. Further, the scorecard 115 communicates with all the participant's active gaming cards 102, 105,109 and 112 to monitor and keep score, using pathway 116.

Thus, the exemplary wireless gaming ad-hoc network 114 includes the trading cards, scorecard and communication between the trading cards and communication between the trading cards and the score card. The participants provide commands to the trading cards to initiate various gaming activities.

In one embodiment, one or more trading cards participating in one ad-hoc network may communicate with one or more trading cards participating in another ad-hoc network. For example, referring to FIG. 1, the trading card 102 of participant 101 participating in the ad-hoc wireless network 114, can send and receive messages to and from trading card 126 of participant 118 in another ad-hoc gaming network 117, using pathway 121. Similarly, the trading card 109 of participant 108 participating in the ad-hoc wireless network 114 can send and receive messages to and from trading card 128 of participant 119. Exemplary communication operation between two trading cards in an ad-hoc network will now be described, for example, between trading card 102 and trading card 130.

Initially, the participant 101 encodes a message to be sent into the trading card 102. In one embodiment, this may be performed by speaking a message into a microphone of the trading card 102, and issuing a command to store the audio message in the trading card 102. Then, a command to transmit the audio message, followed by the recipient's game handle, for example, trading card 130's game handle will be issued to the trading card 102. The trading card 102 assembles the message to be sent and transmits the message. The message may be transmitted as a broadcast message. For example, the message is transmitted via pathway 121, to a participant with trading card 126 in a different ad-hoc network 118.

The trading card 126 further re-transmits the message to yet another participant with trading card 128 in yet another ad-hoc network 119, via a pathway 124. The broadcast message will be rejected and retransmitted to other trading cards, by the originating trading card 102 or other trading cards, for example trading cards 126 and 128 by means of pre-established state of networks, as the message is intended for trading card 130.

In addition to receiving the message sent by trading card 102, the trading card 128 of in ad-hoc network 119, may receive other similar messages from a different participant's trading card such as trading card 109, for example, via pathway 120. Then, the participant's trading card 128 in the ad-hoc network 119, further transmits the message or messages via pathways 122 and 123 to the intended participant's trading card 130 in the ad-hoc network 117. A brief discussion of such messaging follows.

For those skilled in the art of IEEE 802.11 Ethernet standard, it will be apparent that the gamer's profile can be attributed to a pre-assigned number or an ad-hoc established number while setting up the network. The networking standards such as IEEE 802.11 and IEEE 802.15 may use an addressing mechanism, which allows participants in an ad-hoc formed network, to locally generate a network number, which is then maintained by all the trading cards of participants.

Also, each participant's trading card may further keep track of other such networks that are within the communication proximity of the current participant's trading card. Such other network's addresses may be maintained in the trading card processing engines non-volatile memory as required for an indefinite time. In this way, each trading card in an ad-hoc network knows the presence and identity of other trading cards in its vicinity.

In an exemplary transmission of a message by a sending trading card, the sending trading card assembles a message with the receiver trading card's handle and broadcast the message. This message is received by other trading cards in the vicinity of the sending trading card and accept the message, if the trading card is the receiver trading card. Otherwise, the message is re-broadcast to other trading cards in the vicinity. In one embodiment, if the received message contains a network address for another trading card, then the processing engine of the trading card that received the message tries to match the recipient's address in its repository of known networks to retransmit the message.

In this way, the message sent by the sending trading card will eventually reach the receiving trading card. In one embodiment, an acknowledgement message may be sent by the receiving trading card, addressed to the sending trading card, as a broadcast message.

It should be noted that, based upon the accumulation of network addresses in the non-volatile memory of the trading cards of the exemplary system, each trading card would attempt to pass the message to its known recipient's trading card, until the trading card receives an acknowledgement, regardless of whether the recipient's trading card is within reach or not. Thus each of the trading card will be transmitting and receiving information, based on some protocol as mentioned before, for example IEEE 802.15.4, which enables embedded network node identification, addressing etc. Thus, the present disclosure provides a means for such an ad-hoc message passing techniques.

An exemplary construction of a trading card of the present disclosure will be described with reference to FIG. 2. The trading card 200 includes a substrate 201, energy harvester 202, a display 203, push button switches 204, peripheral access port 205, personality module access port 206, audio output port 207, thumb wheel 208, sliding switches 209, 210, 211, external antenna access port 212, holographic display 213, hologram light emitting device 215 for the holographic display 213, light emitting devices 216, 217, 218, microphone input 219, sound transducer 220 and a personality module 226. An exemplary holographic image 214 that may be projected during operation is also shown.

The trading card 200 further includes electronics and software modules to perform various functions. For example, the trading card 200 may include a processing engine, memory, peripheral access module, display system module, accessory interface module and the like. Although not shown in FIG. 2, these modules will be further described with reference to FIGS. 7, 8*a*, 8*b* and 9.

The substrate 201 may be of generally utilized substrates in the electronic printed circuit board manufacturing techniques. One such commonly utilized rigid substrate is known as FR4. In some embodiments, substrates that enable in-situ fabrication of electronic components may be used. An exemplary in-situ fabrication of electronic components may be printed electronic components fabricated over the substrate. Various electrical and electronic components of the trading card 200 are fabricated on the substrate 201.

Printed electronics fabrication as researched by Prof. Dr. Arved Hübler, head of the Institute for Print and Media Technology at Chemnitz University, Institute for Print and Media Technology at Chemnitz University, BASF Future Business and researchers from BASF, Lucent Technologies Bell Labs, and also provided as a commercial service by the company printed systems GmbH in Chemnitz, (Printed systems GmbH Altchemnitzer, Straβe-27,09120, Chemnitz, Germany) may be used in fabricating various electrical and electronic components of the trading card 200.

In one embodiment, the form factor or shape of the substrate 201 may be similar to that of a traditional game playing card or a credit card. The thickness of the trading card 200 may be selected to accommodate the thickness of the electronic components on the substrate 201, so as to achieve substantially planar surface profile for the trading card 200.

In one embodiment, all electrical and electronic components are constructed on the substrate 201. This may be accomplished by utilizing one or more manufacturing technologies such as printed circuit board manufacturing, printed electronic components, chip on substrate bonding and assemblage of passive components.

The substrate 201 and other components may finally be enclosed in a protective cover to construct the trading card 200. The protective cover of the trading card 200 may provide a finished planar surface. The protective cover may be fabricated by utilizing transparent epoxies or glues, so that only the utility surfaces, such as buttons, peripheral interconnects etc., are exposed to the user of the system.

The energy harvester 202 may be of the form of plural solar cells, or inductive coils. The solar cells convert light into electrical power, whereas the inductive coils pick up electro magnetic energy in the vicinity to convert to electrical energy. The energy harvester may also be of infrared energy collector type or micro fuel cells or piezo electric material such as lead zirconate titanate crystals. The generated electric charge by the energy harvester 202 may be collected via a power regulator device.

For example, a power regulator device such as TPS61200 from Texas instruments may be used to store electrical energy in rechargeable battery cells. Further implementation details are available on line on www.ti.com, or at http://focus.ti.com/lit/ds/symlink/tps61200.pdf, which is herein incorporated by reference in their entirety.

The display 203, may be a light emitting diode, liquid crystal display or the like. In one embodiment, the display 203 may be fabricated as a printed electronic organic light emitting device configured to display plural digits, for example, as a segmented alpha numeric display. In one embodiment, the display 203 may be fabricated on the substrate 201 along with other electronic components using printed electronics manufacturing process as previously described. In some embodiments, other off the shelf products such as P12101 available from http://www.usmicroproducts.com/prod_oled.htm may also be utilized.

Figure 2:
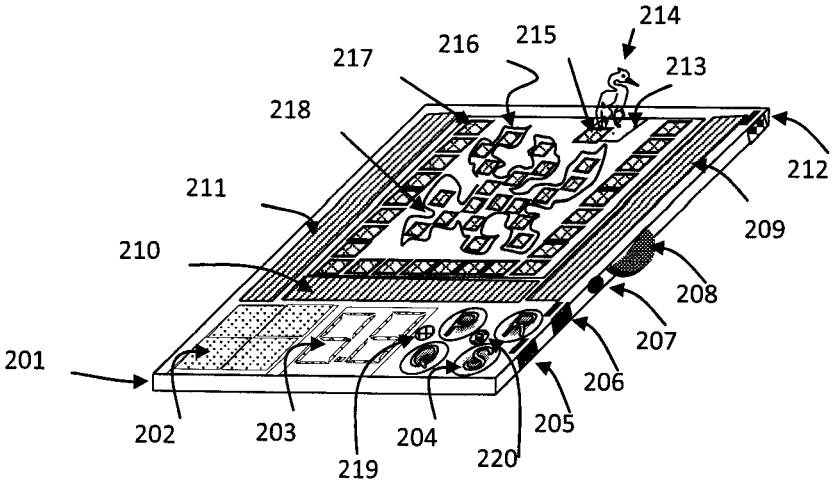
FIG. 2 is a diagram illustrating an embodiment of the trading card of the present disclosure.

The push button switches 204, shown in the FIG. 2 as "P", "Q", "R" and "S", are configured to receive input from a user. For example, the push button switches 204 may be of type described in U.S. Pat. No. 5,144,104 which is herein incorporated by reference in their entirety. In some embodiments, other switches may be used. For example membrane type switches such as those provided for sale by GGI international, referenced at http://www.ggi-international.com/en/products/membrane/switches/may also be used.

The trading card 200 includes a personality module 226. The personality module 226 in one embodiment may include memory to store one or more attributes of the trading card. The personality module 226 may store user attributes, game attributes and game rules.

The user attribute may include access control information, statistics and game score. The access control information may include information related to accessing and using the trading card 200. The statistics may include information related to trading card ranking, number of opponent trading card the trading card has played with, number of opponent trading card that was defeated, status of any pending messages to be sent, ad-hoc network performance information such as number of message transmits, message retransmits, rejected messages, time to receive message acknowledgements, signal strength of other trading cards in the vicinity, power remaining in the trading card and the like.

The game score attribute may include how the game will be scored, for example, initial values for various game attributes, amount by which the values for various game attributes will be updated based upon the outcome of the game played etc.

The game attributes may include specific information related to a game to be played using the trading card. The game attribute may include certain information pre-set or initialized during original manufacture. The game attributes may be modified or customized by a user. Further, the game attributes may be modified, based upon the outcome of a game that is played with the trading card.

The game rules may include one or more rules to be followed in using the trading card in a given game.

In one embodiment, the personality module 226 may be internal to the trading card 200. In one embodiment, an external personality module may be coupled to the trading card 200, for example, using the personality module access port 206. In one embodiment, the trading card 200 may include both an internal personality module and an external personality module.

The peripheral module interface ports 205 and personality module access port 206 may be built on the substrate with contact leads that are configured as connectors to couple to external devices. The peripheral module interface ports 205 and personality module access port 206 may be fabricated over the substrate as part of the substrate printed circuit board metallization.

In one embodiment, the peripheral module interface ports 205 and personality module access port 206 may be configured as voids or openings within the thickness of the substrate, forming the female part of the connector. A cable with a complementary male counterpart connector may couple the peripheral module interface ports 205 to an external device such as a computer. A complementary male counter part connector coupled to an external personality module (not shown) may couple the external personality module to the personality module access port 206. A detailed description of the external personality module is described later with reference to FIG. 10.

The audio output port 207 is configured to couple to an external audio reproducing device. In one embodiment, the audio port 207 is assembled on the substrate 201 using conventional components.

The thumbwheel 208 is a user interface to receive user inputs. The thumbwheel 208 may be assembled on the substrate 201 using surface mount thumb wheel potentiometers. The thumbwheel may have an optional "lock" input switch as part of the input into the processing engine. The thumbwheel may be used to provide a voltage into the processing engine to convert the continuously varying input voltage into a digital representation of the input command utilizing an analog to digital converters in the processing engine.

The sliding switches 209, 210 and 211 may be used to receive user input. In one embodiment, the sliding switches 209, 210 and 211 may be manufactured as part of the substrate 201 using printed electronics.

In one embodiment, the sliding switches 209, 210 and 211 may be touch sensitive switches. For example, sliding switches 209, 210 and 211 may be of the capacitive type, wherein a capacitive circuitry provides the processing engine with varying voltages based on user's touch on a portion of a panel of the sliding switches 209, 210 and 211.

The sliding switches 209, 210 and 211 may be configured such that sliding a users finger on the panel of the sliding switches 209, 210 and 211 up or down the panel increases or decreases the voltage presented at an analog to digital converters in the processing engine.

The external antenna access port 212 may be used to couple to an external antenna device, so as to extend the range of wireless communication. The external antenna access port 212 may be constructed similar to the construction of peripheral module interface ports 205 and personality module access port 206 as previously described.

The holographic display 213 may be a transmissive type of hologram, which has multiple recordings of a playing card element, such as an exemplary stork shown. The active projected holographic image 214, in operation, is displayed based on the number of active reference beams incident on the hologram. The light emitting device 215, or plurality of such light emitting devices, generates the reference beams. A detailed description of this holographic display is stated as part of the description of FIG. 16 in this document.

The light emitting devices, described further on in this patent disclosure may be of many various types of light emitting diodes, organic light emitting diodes (OLED), Polymer light-emitting diodes (PLED) or any other forms of devices that emit light. The light emitting devices may be assembled on the substrate. In one embodiment, in-situ fabrication of the light emitting devices may be performed by printed electronics process. For example, printed electronics process may be used to pattern and manufacture, in-situ, the light emitting devices, on the substrate.

The light emitting devices 216, 217 may be surface mount light emitting diodes. The light emitting devices 216 may be spatially arranged to conform to the trading card's artwork. The light emitting devices 217 may be configured to display gaming cards attributes like, health, strength or capability. The light emitting devices 217 may be arranged in a vertical, horizontal or oblique manner, to indicate various levels of different attributes of the gaming card.

The trading card 200 may include artwork The artwork 218 may be imprinted on the surface. The artwork may provide a visual cue to the type or kind of trading card.

The microphone input 219 may be configured to receive voice input commands from a user. The microphone input 219 may be an off the shelf surface mount device such as SPM0204HD5-2 available from Knowles Acoustics company.

The sound transducer 220 may be used to produce audio output. The sound transducer 220 may be an off the shelf surface mount device such as CMT-1102 by the CUI Inc company.

Figure 3A:
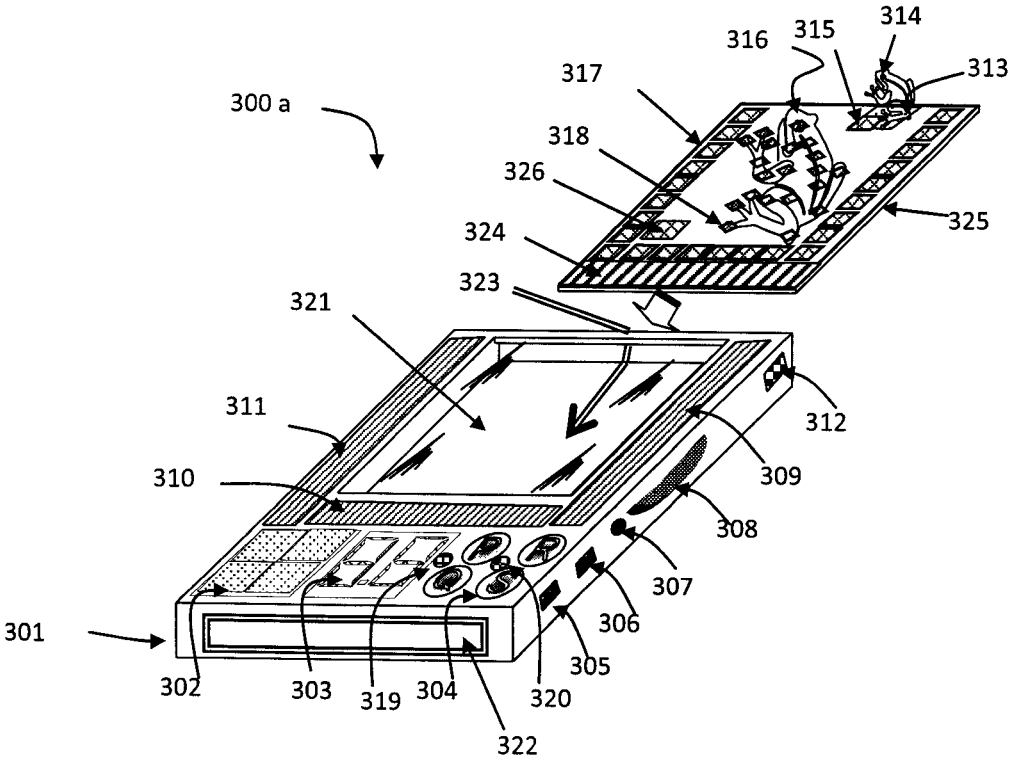
FIG. 3*a* is a diagram illustrating an alternate embodiment of the trading card of the present disclosure.

Reference is now made to FIG. 3*a*, an exemplary alternate embodiment of a trading card of the current disclosure.

In this embodiment, the gaming unit 300*a* includes a base unit 301 and a substrate 325. The substrate 325 is configured to couple to the base unit 301 and the gaming unit 300*a* is configured to operate as a unit.

The gaming unit 300*a* further includes electronics and software modules to perform various functions. For example, the gaming unit 300*a* may include a processing engine, memory, peripheral access module, display system module, accessory interface module and the like. Although not shown in FIG. 3*a*, these modules will be further described with reference to FIGS. 7, 8*a*, 8*b* and 9.

The base unit 301 further includes energy harvester 302, a display 303, push button switches 304, peripheral access port 305, personality module access port 306, audio output port 307, thumb wheel 308, sliding switch 309, 310, 311, external antenna access port 312, microphone input 319 and sound transducer 320. An opening 323 in the base unit 301 is configured to receive the substrate 325. Portion 321 of the base unit 301 may be covered by a transparent material (shown as a shaded surface) is configured to permit the viewing or display of portions of the substrate 325 when coupled to the base unit 301.

In some embodiments, the hand held unit 301, may incorporate a storage access port 322, providing access to a compartment where additional substrates 325 may be stored for future use.

The substrate 325 may be fabricated using printed electronics manufacturing process. The substrate 325 in one embodiment includes a personality module 326, holographic display 313, hologram light emitting device 315 for the holographic display 313, light emitting devices 316, 317, artwork 318, and a plurality terminals 324. The terminals 324 are configured to electrically mate with a connector (not shown) in the hand held device 301. The terminals 324 may be formed by metallization of the substrate 325 during the fabrication of the substrate, for example, using printed electronics process.

As one skilled in the art appreciates, the gaming unit 300 in one embodiment may function similar to the trading card 200, when the substrate 325 is mated with the base unit 301. In one embodiment, the control interfaces are disposed on the base unit and the display functions and devices specific to a game are disposed on the substrate. Since one base unit 301, may be configured to receive different substrates 325, the gaming unit 300 provides a more cost effective gaming system where a plurality of substrates may be interchangeably used with the base unit 301. In this embodiment, the substrate 325 may be used as a playing card that may be exchanged in a game.

In one embodiment, energy harvester 302, display 303, push button switches 304, peripheral access port 305, personality module access port 306, audio output port 307, thumb wheel 308, sliding switch 309, 310, 311, external antenna access port 312, microphone input 319 and sound transducer 320 described with reference to FIG. 3*a* may be similar to the energy harvester 202, display 203, push button switches 204, peripheral access port 205, personality module access port 206, audio output port 207, thumb wheel 208, sliding switch 209, 210, 211, external antenna access port 212, microphone input 219 and sound transducer 220 described with reference to FIG. 2 respectively.

In one embodiment, the personality module 326, holographic display 313, hologram light emitting device 315 for the holographic display 313, light emitting devices 316, 317 and artwork 318 described with reference to FIG. 3*a* may be similar to the personality module 226, holographic display 213, hologram light emitting device 215 for the holographic display 213, light emitting devices 216, 217 and artwork 218 described with reference to FIG. 2 respectively.

Figure 3B:
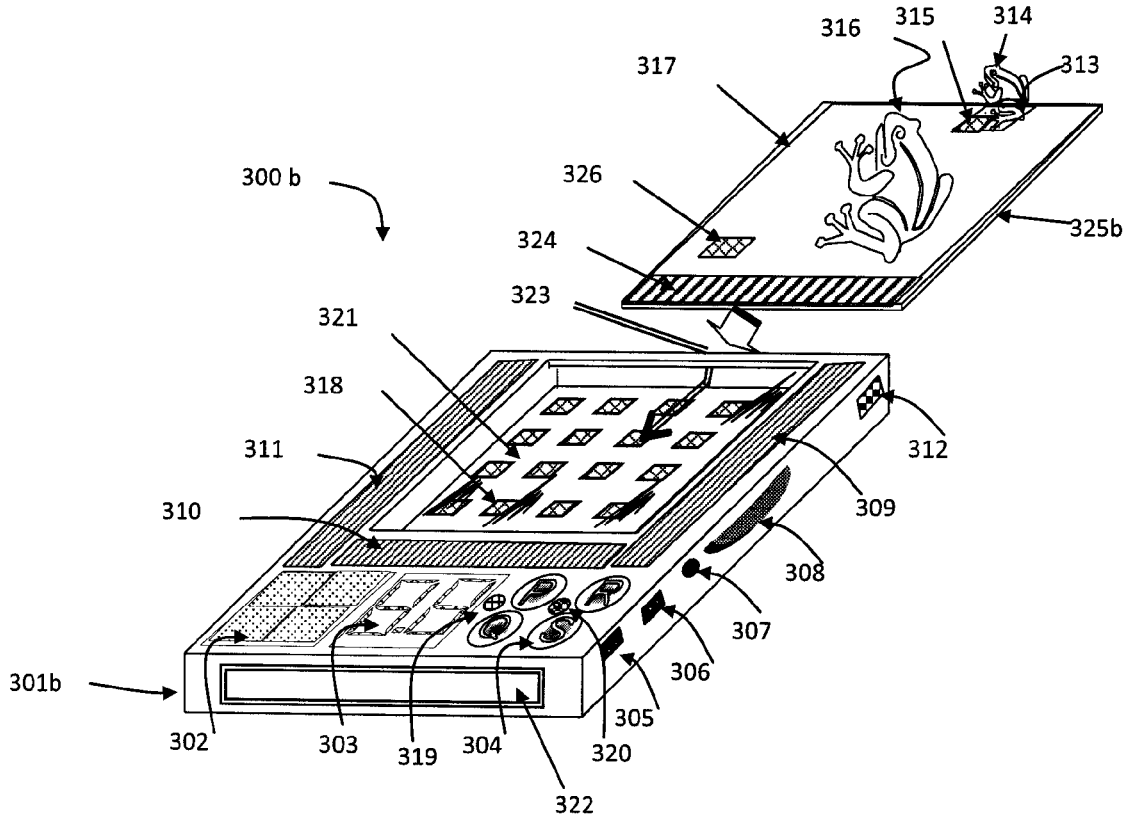
FIG. 3*b* is a diagram illustrating yet another alternate embodiment of the trading card of the present disclosure.

FIG. 3*b* shows yet another alternate embodiment of a gaming unit 300*b* of the present disclosure. In this embodiment, the gaming unit 300*b* may be similar to the gaming unit 300*a* shown with reference to FIG. 3*a*. However, the base unit of gaming unit 300*b* may include some of the components that were disposed over the substrate 325 of the gaming unit 300*a*.

For example, the substrate 325*b* is configured to couple to the base unit 301*b* and the gaming unit 300*b* is configured to operate as a unit.

The gaming unit 300*b* further includes electronics and software modules to perform various functions. For example, the gaming unit 300*b* may include a processing engine, memory, peripheral access module, display system module, accessory interface module and the like. Although not shown in FIG. 3*b*, these modules will be further described with reference to FIGS. 7, 8*a*, 8*b* and 9.

The substrate 325*b* in one embodiment includes a personality module 326, artwork 318, and plurality of terminals 324. The terminals 324 are configured to electrically mate with a connector (not shown) in the base unit 301*b*. The terminals 324 may be formed by metallization of the substrate 325*b* during the fabrication of the substrate, for example, using printed electronics process.

The base unit 301*b* further comprises of energy harvester 302, a display 303, push button switches 304, peripheral access port 305, personality module access port 306, audio output port 307, thumb wheel 308, sliding switch 309, 310, 311, external antenna access port 312, microphone input 319 and sound transducer 320. An opening 323 in the base unit 301*b* is configured to receive the substrate 325*b*.

Portion 321 of the base unit 301*b* may include light emitting devices 316, 317. The light emitting devices 316 may be disposed in the portion 321 such that the artwork 318 of the substrate 325*b* when coupled to the hand held unit 301*b* may be located over the light emitting devices 316 so that the artwork 318 may be selectively illuminated from below, by selectively energizing the light emitting devices 316. In some embodiments, light transporting devices may be embedded in the substrate 325*b*. For example, light transporting devices like light pipes or optical fibers may be used.

In some embodiments, the substrate 325*b* may include a holographic display 313. The hologram light emitting device 315 for the holographic display 313 in one embodiment may be disposed in the substrate 315*b*. In some embodiments, the hologram light emitting device 315 for the holographic display may be disposed in the base unit 301*b*.

For example, the hologram light emitting device 315 may be disposed in the portion 321, such that when the substrate 325*b* is coupled to the base unit 301*b*, the holographic display 313 may be operatively disposed above the hologram light emitting device 315. By selectively energizing the hologram light emitting device 315, the hologram 314 may be projected using the combination of the holographic display 313 and the hologram light emitting device 315.

Portion 321 of the base unit 301 may be covered by a transparent material (not shown) that is configured to permit the viewing or display of portions of the substrate 325*b* when coupled to the base unit 301.

In some embodiments, the base unit 301*b*, may incorporate a storage access port 322, providing access to a compartment where additional substrates 325 may be stored for future use.

In one embodiment, the substrate 325*b* may be fabricated using printed electronics manufacturing process. In one embodiment, the personality module 326, holographic display 313, hologram light emitting device 315 for the holographic display 313, light emitting devices 316, 317 and artwork 318 described with reference to FIG. 3*b* may be similar to the personality module 226, holographic display 213, hologram light emitting device 215 for the holographic display 213, light emitting devices 216, 217 and artwork 218 described with reference to FIG. 2 respectively.

Figure 4:
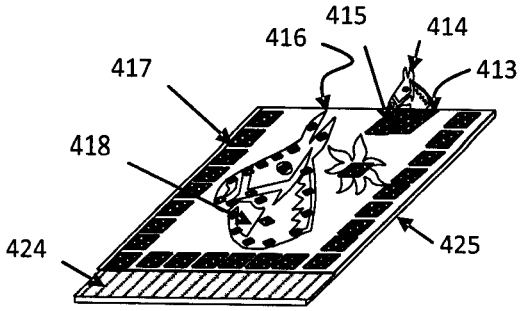
FIGS. 4 and 5 are diagrams of two examples of trading cards.
Figure 5:
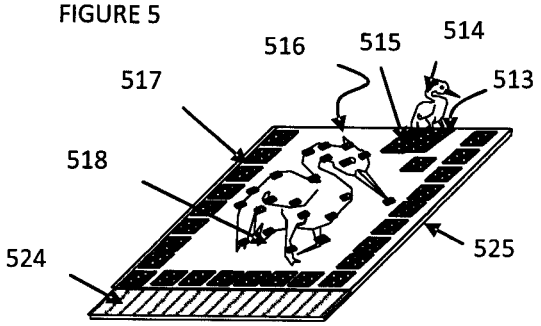

FIGS. 4 and 5 show alternate embodiments of substrates for use with the base unit 301.

Now referring to FIG. 4, an alternate substrate 425 is shown. The substrate 425 may be similar in construction to substrate 325. Some of the differences include the configuration of the holographic display 413, hologram light emitting device 415 for the holographic display 413, light emitting device 416 and artwork 418.

Now referring to FIG. 5, an alternate substrate 525 is shown. The substrate 525 is similar in construction as substrate 325 and 425. Some of the differences include the configuration of the holographic display 513, hologram light emitting device 515 for the holographic display 513, light emitting device 516 and artwork 518.

As one skilled in the art appreciates, the substrates 325*a*, 325*b*, 425 and 525 may be configured to operate in a base unit 301*a* or 301*b*, but each substrate 325*a*, 325*b*, 425 and 525 may be configured differently to exhibit different personality, as described above. Although some variations of the substrate configurations are described, as one skilled in the art appreciates, other variations to the substrate may be made to distinguish the attributes of different substrates. Each of the substrates 325, 425 and 525 may be used as trading cards in a game.

Figure 6:
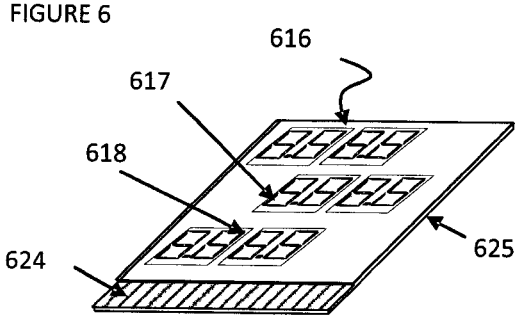
FIG. 6 is a diagram illustrating an exemplary trading card adapted to keep score of a game.

Now referring to FIG. 6, an yet another variation of a substrate that may be configured for use with base unit 301*a* and 301*b* is described. For example, substrate 625 may be configured as a score card. The substrate 625 may include a plurality of display units 616, 617 and 618. Each of the display units 616, 617 and 618 may be configured to display various attributes of a game. For example, some of the attributes to display may include one or more of various gamer rule displays, number of participants, teams, hand held units power and status and scores. As one skilled in the art appreciate, a game may be played using the alternate embodiment disclosed with reference to FIGS. 3*a* and 3*b* with or without the use of the substrate 625, as a score card.

As previously discussed, trading card of FIG. 2 and gaming unit of 3*a* and 3*b* may include processing engine, memory, peripheral access module, accessory interface module, display system module and the like. These modules will now be described in detail, with reference to FIG. 7 and trading card 700. The trading card 700 may be similar to the trading card 200, gaming unit 300*a* and 300*b*.

Figure 7:
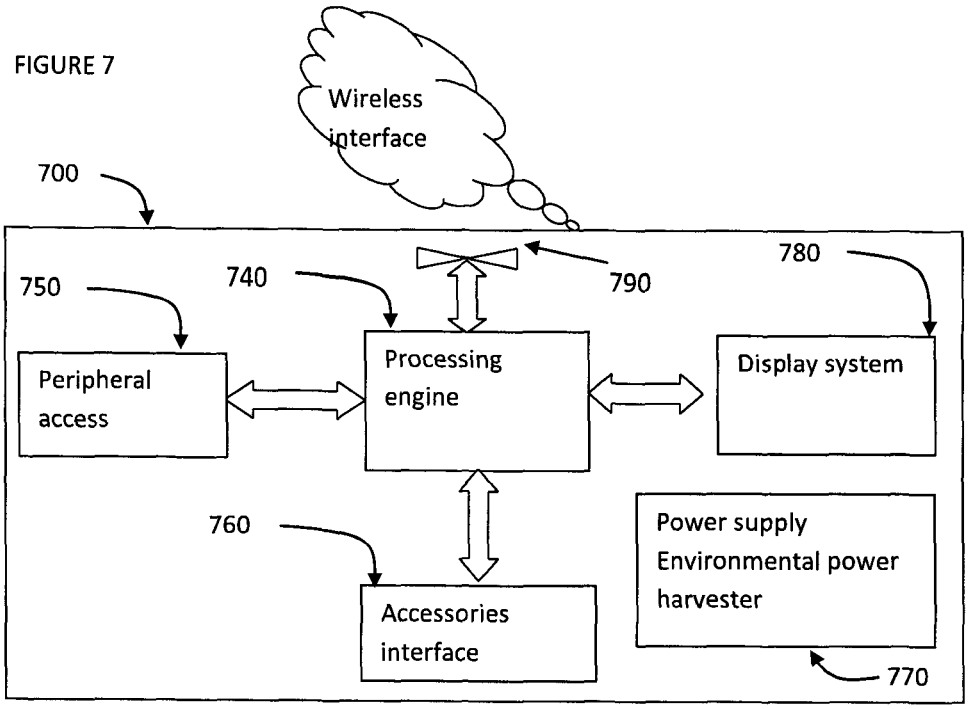
FIG. 7 is a block diagram illustrating in detail, an exemplary trading card of this disclosure.

FIG. 7 is a block diagram illustrating in detail, an exemplary trading card 700 of this disclosure. The trading card 700 includes a processing engine 740, peripheral access module 750, accessory interface module 760, power source module 770, display system 780, and a wireless interface 790. The peripheral access module 750, accessory interface module 760, power source module 770, display system 780 and the wireless interface 790 are all operationally coupled to the processing engine 740. Various modules of the trading card 700 will now be described.

Figure 8A:
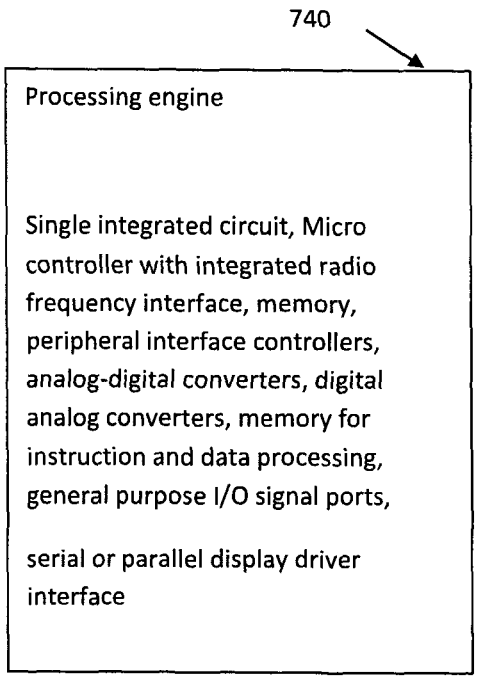
FIG. 8*a* is a block diagram illustrating in greater detail the functions of the processing engine integrated into a single integrated circuit.
Figure 8B:
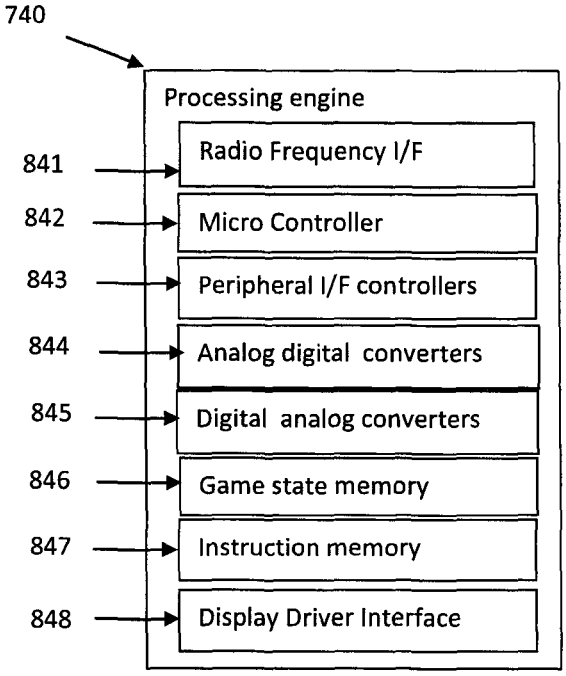
FIG. 8*b* is a block diagram illustrating in greater detail the functional blocks of the processing engine implemented as separate integrated circuits or components.

FIGS. 8*a* and 8*b* show two exemplary implementation of the processing engine 740. FIG. 8*a* shows an exemplary implementation of the processing engine 740 as a single integrated circuit. FIG. 8*b* shows an exemplary implementation of the processing engine 740 implemented as separate integrated circuits or components.

Processing engine 740 in one embodiment as shown in FIG. 8*a* may include a micro controller with an integrated radio frequency interface, memory, peripheral interface controllers, analog-digital converters, digital-analog converters, memory for instructions and data processing, general purpose I/O signal ports, serial or parallel display driver interface.

Part of the Processing engine 740 of FIG. 8*a* may be implemented using a micro controller such as the CC2340 from Texas Instruments at: http://focus.ti.com/docs/prod/folders/print/cc2430.html, further described in the data sheet available from Texas Instruments Company. The processing engine 740 of FIG. 8*a* may be implemented as a single integrated circuit, with various functional blocks described above.

In an alternate embodiment, the processing engine 740 may be implemented with multiple integrated circuits, as shown in FIG. 8*b*. For example, a radio frequency interface circuit, micro controller, peripheral interface controllers, analog to digital converters, digital to analog converters, game state memory, instruction memory and display driver interface circuit.

For example, the radio frequency interface may be a separate circuit. In an exemplary embodiment, the processing engine can be of the type MSP430, the application data for which is available at: http://focus.ti.com/docs/prod/folders/print/msp430f2274.html. The radio frequency interface may be of the type CC2420 also available at: http://focus.ti.com/docs/prod/folders/print/cc2420.html.

The Processing engine 740 of FIG. 8*b* may include a micro controller 843 that is coupled to various other functional circuits. For example, the micro controller 842 may be coupled to a peripheral interface controller 843, a analog digital converter 844, a digital analog converter 845, a game state memory 846, which may be volatile or non-volatile, such as commonly known flash memory devices, instruction memory 847 also of the commonly known static random access memory or dynamic random access memory, and finally a display driver interface 848. The display driver interface 848 is further described in FIG. 12.

Figure 9:
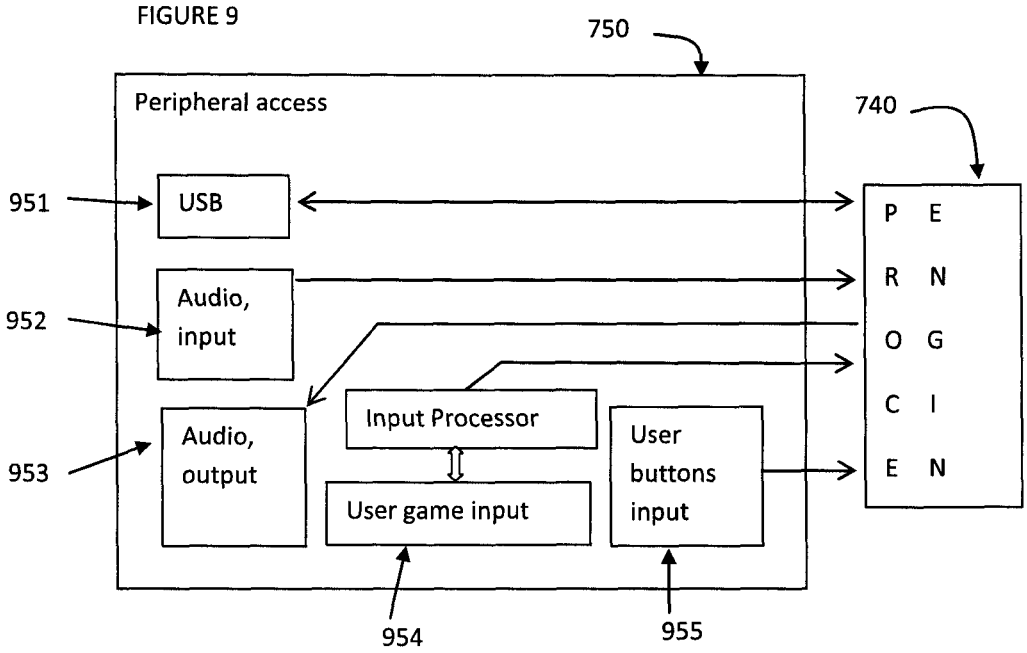
FIG. 9 is a block diagram illustrating in greater detail one possible arrangement of the peripheral access interface with the processing engine.

FIG. 9 shows the block diagram of an exemplary peripheral access module 750. The peripheral access module 750 includes an USB (Universal Serial Bus) interface 951, an audio input device such as a microphone 952, an audio output device such as a speaker or a transducer 953, user game input and input processor 954, and user input control buttons, all of which are operationally coupled to the processing engine 740. The user game input and input processor 954, may be sliding capacitive touch panels as described in the data sheets for the product QT1106 from http://www.qprox.com/.

Figure 10:
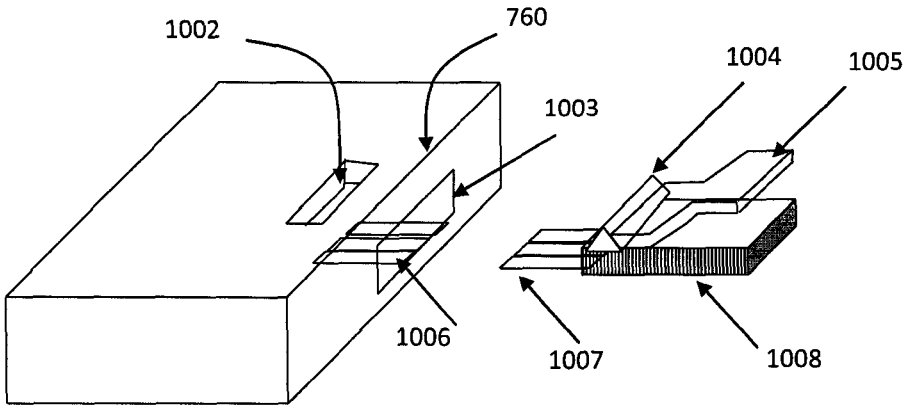
FIG. 10 is a diagram illustrating, as an example, one possible implementation of an external peripheral module interface construction.

A physical adaptation of an exemplary port that may be configured as an accessory interface module 760 is shown in FIG. 10.

The accessory interface module 760 in one embodiment may be configured as a personality module interface port, for example, personality module interface port 206 of FIG. 2 and personality module interface port 306 of FIGS. 3*a* and 3*b*.

In yet another embodiment, the accessory interface module 760 may be configured as external peripheral module interface, for example, external peripheral module interface 205 of FIG. 2 and external peripheral module interface 305 of FIGS. 3*a* and 3*b*.

As one skilled in the art appreciates, the accessory interface module 760 may be configured as a serial interface, parallel interface, a two-wire interface or an I2C interface.

In one embodiment, accessory interface module 760 may be configured such that an in-situ manufacturing process, like printed electronics manufacturing process may be used to fabricate the accessory interface module 760.

Referring to FIG. 10, the accessory interface module 760 includes terminals 1006 disposed in an opening 1003. The terminals 1006 may be disposed on the substrate of an trading card of FIG. 2 or on the printed circuit board 301 of the gaming device 300 of FIG. 3. The opening 1003 is configured to receive an external device 1008. The external device 1008 includes a device terminal 1007 that is configured to couple with the terminals 1006 of the accessory interface module 760.

A locking mechanism may optionally be provided to securely hold the external device 1008 and assist in maintaining the coupling between the external device 1008 and the peripheral interface module 760. For example, the external device 1008 may include a movable tab 1004 that is configured to be disposed in a slot 1002 of the accessory interface module 760. A leaf 1005, for example, formed of a tensile plastic or similar material may extend from the movable tab 1004.

When the external device 1008 is inserted into the peripheral interface module 760, the leaf 1005 may be configured to rest on the top surface of the opening 1003 so as to positively urge the device terminal 1007 toward the terminal 1006 so as to couple the device terminal 1007 with the terminal 1006. The movable tab 1004 is positioned inside the slot 1002 so as to lock the external device 1008 inside the accessory interface module 760.

Figure 11:
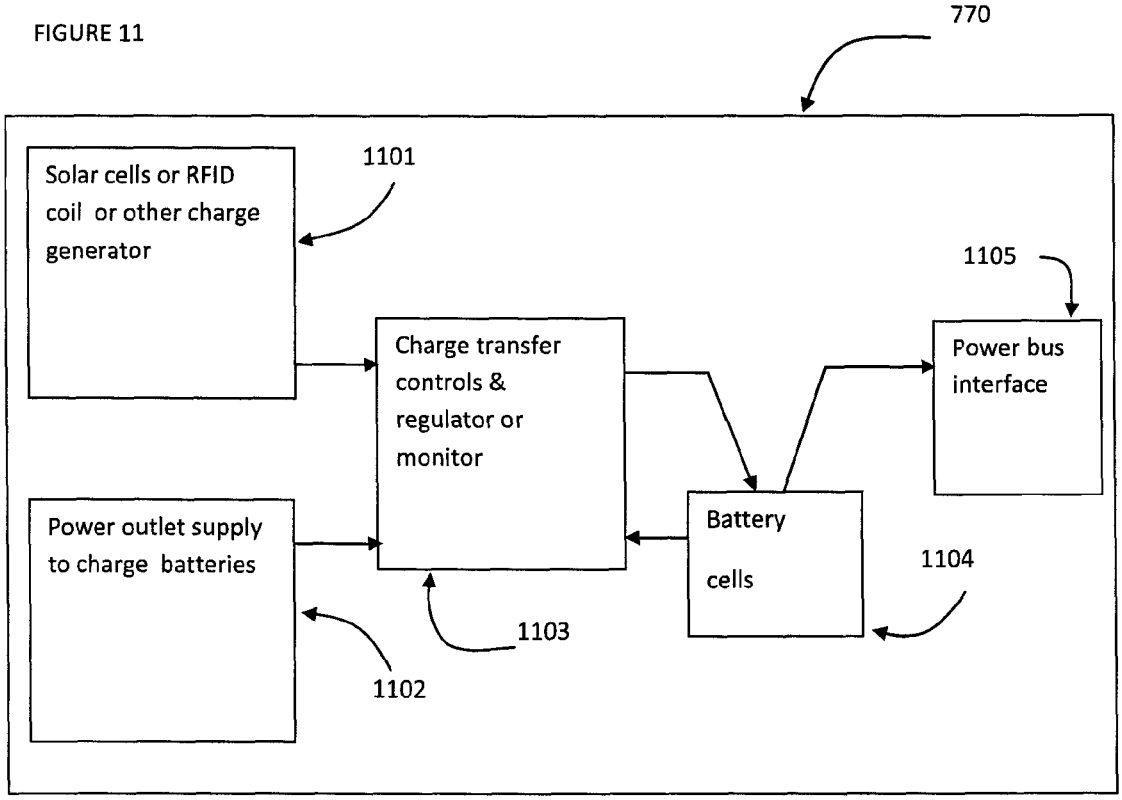
FIG. 11 is a block diagram illustrating in greater detail one possible arrangement of the energy or power supply into the system.

FIG. 11 shows block diagram of an exemplary power source module 770. The power source module includes a energy harvester 1101. The energy harvester 1001 may convert one or more forms of energy, such as solar or light, or sound or heat or electrical energy, into a form of electrical energy that can be stored for current or future use. The energy harvester 1101 may consist of coils of metallization as part of printed electronics, or piezo crystals to convert mechanical to electrical energy. The energy harvester 1101 is coupled to a charge transfer controller 1103.

The charge transfer controller 1102 may be an integrated circuit such as TPS61200 available from Texas Instruments as previously mentioned in this disclosure. Details of the circuitry required for the charge transfer controller is described in the data sheets for TPS61200, http://focus.ti.com/lit/ds/symlink/tps61200.pdf and is incorporated herein reference in its entirety. The charge transfer controller 1103 may also be coupled to an optional power supply connector 1102 to receive external power. The charge transfer controller 1103 is coupled to and feeds the battery cells 1104, for example, to recharge the battery cells 1104. The battery cells 1104 supply power to the system through a power bus interface 1105.

Figure 12:
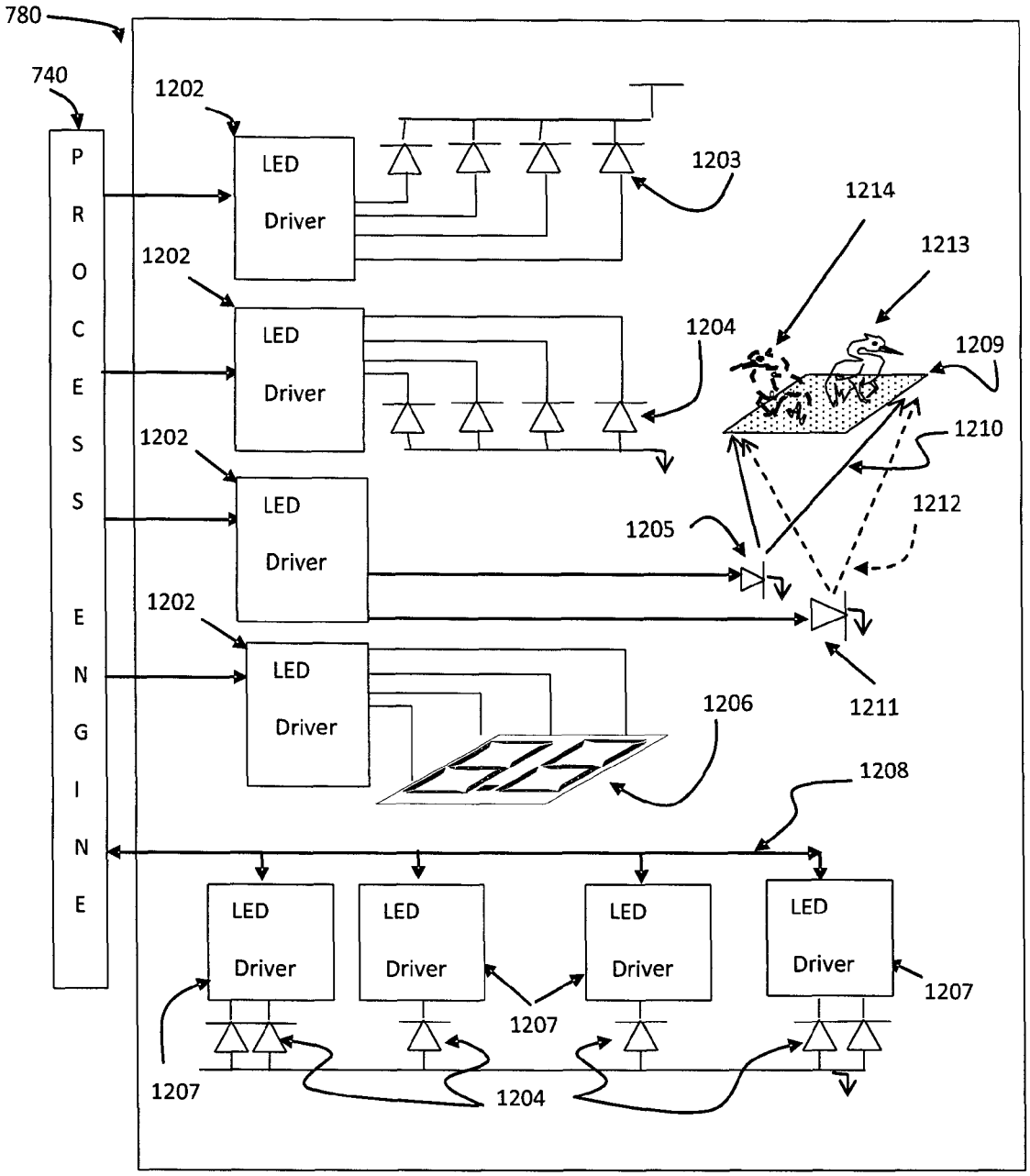
FIG. 12 is a diagram illustrating in greater detail several possible arrangements of the light emitting device interface with the processing engine.

FIG. 12 shows an exemplary display system 780. The display system includes a plurality of LED drivers 1202, such as MAX6956 that can be purchased from the manufacturer or a distributor. The details of connectivity of these LED drivers are found in the following web link: http://www.maximic-.com/quick_view2.cfm/qv_pk/3503, and is incorporated herein by reference in their entirety. In one embodiment, the processing engine 740 will communicate data and commands over an industry standard interface called the "I2C" or "IIC" published by Philips Semiconductor Company.

Again, referring to FIG. 12, the LED driver 1202 can drive common anode type of LED devices 1203, or common cathode type of LED devices 1204. Then the LED drivers can also be utilized to drive other discrete LED 1205, 1211 that may be of either common anode or common cathode types to generate reference beams 1210, 1212 for the hologram 1209. It can be noted that discrete LEDS 1205 and 1211, positioned in different angles with respect to the hologram 1209, will generate reference beams 1210 and 1212 that are incident on the hologram 1209 at different angles, there by generating different images 1213, 1214.

By selectively energizing different reference beams, different images are generated thereby "animating" the image. Details for making transmissive holograms may be found in a literature pertaining to the subject for example in the book "Basics of Holography by P. Hariharan". Referencing the FIG. 12, the LED driver 1202 may also be utilized to drive an alphanumeric display component 1206, as described in the MAX6956's literature at http://www.maximic.com/quick_view2.cfm/qv_pk/3503. Finally, the plurality of LED drivers 1207, connected by the common interconnect 1208, may be utilized to drive one or more LEDs 1204, as shown in FIG. 12.

Figure 13A:
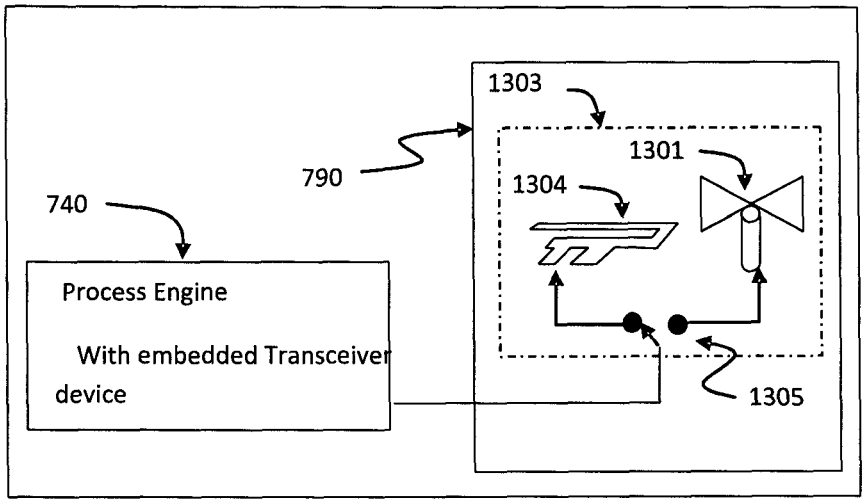
FIGS. 13*a* and 13*b* illustrates two possible arrangements of the wireless transceiver interface with the processing engine.
Figure 13B:
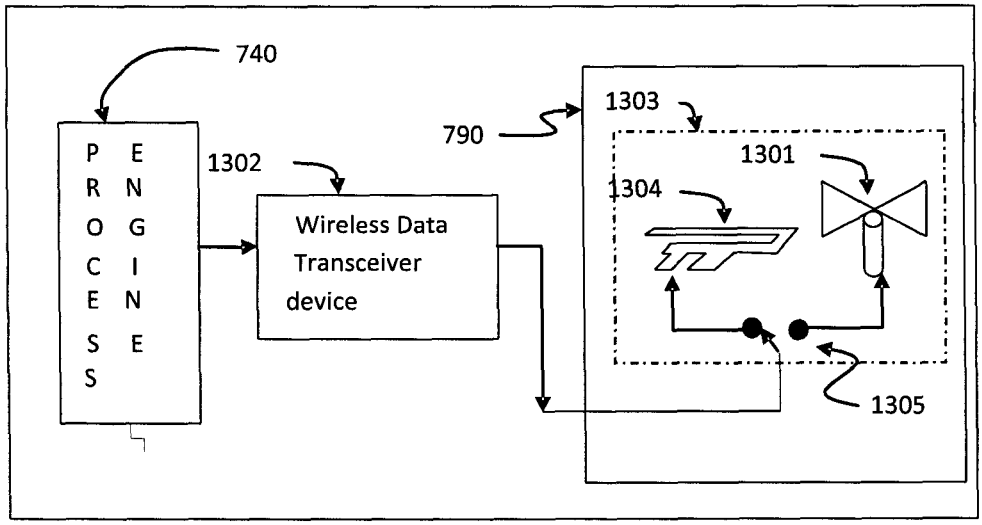

FIGS. 13*a* and 13*b* describe two alternate embodiments of an exemplary wireless subsystem 790.

In one embodiment, as shown in FIG. 13*a*, the processing engine 740 may also include an integrated wireless transceiver, such as the component cc2430 from Texas Instruments. The data sheets and application of this product is at: http://focus.ti.com/docs/prod/folders/print/cc2430.html, and as such is incorporated here in its entirety by reference.

Alternately, as shown in FIG. 13*b*, the wireless transceiver 1302 may be a separate device configured to operatively couple to the processing engine 740 such as wireless transceiver CC2420 available from Texas Instruments may be used. The data sheets and application of this product is available at http://focus.ti.com/docs/prod/folders/print/cc2420.html.

An exemplary wireless subsystem 790 may include a built in antenna 1304, a built in switch 1305, and an external antenna 1301. The external antenna 1301 and built in antenna 1304 may be selectively coupled via the switch 1305.

Figure 14:
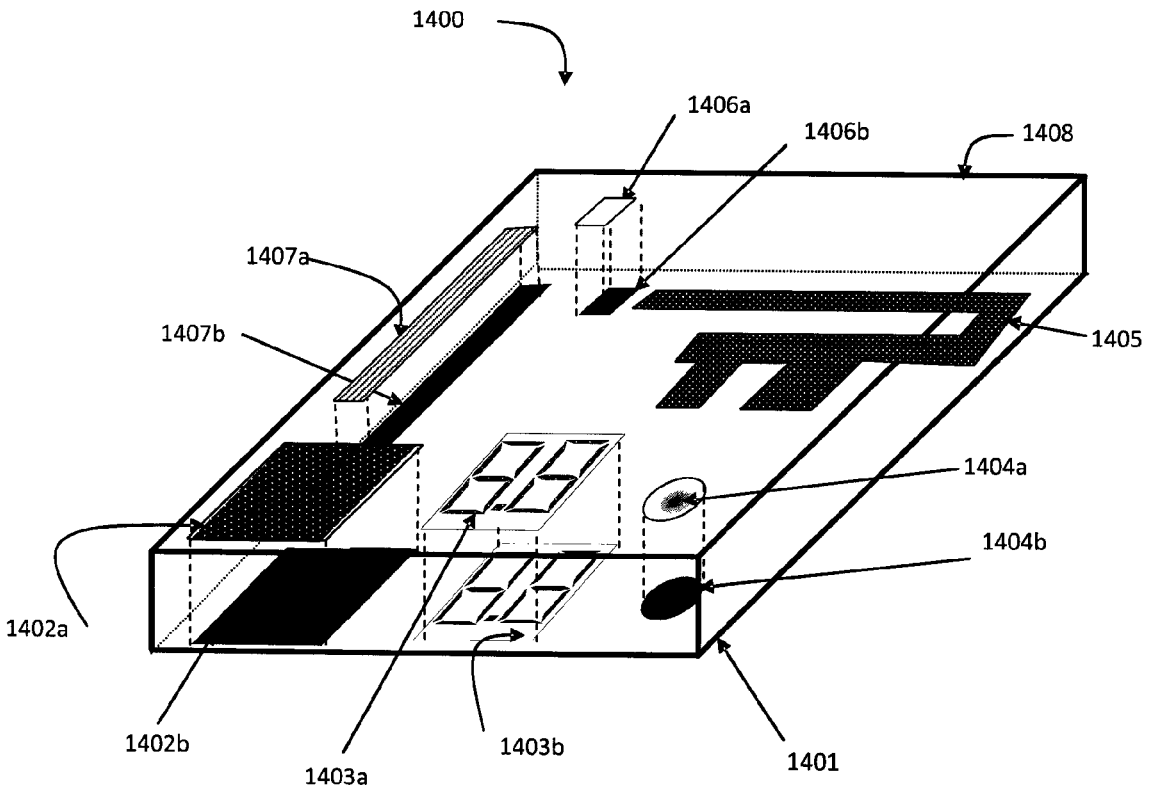
FIG. 14 is a diagram illustrating in greater detail an exemplary construction of the trading card of the present disclosure.

FIG. 14 is a diagram illustrating in greater detail an exemplary layout of a trading card 1400 of the present disclosure. Only some components of the trading card 1400 are shown. For example, the trading card 1400 is constructed over a substrate 1401.

The solar cell 1402*a* is assembled on the surface of the substrate 1401. The solar cell 1402*a* when constructed over the substrate 1401, may extend from the top surface of the substrate 1401 to the top surface 1408 of the trading card 1400. For example, the portion 1402*b* of the solar cell 1402*a* may be disposed on the top surface of the substrate 1401. In one embodiment, the solar cell 1402*a* may be fabricated over the substrate 1401, using in-situ fabrication method like, printed electronics fabrication method. Solar cell 1402*a* may be one example of a energy harvesting device, which harvests light energy.

The alphanumeric display 1403*a* may be of the type APPDA04-41YWA from manufacturer Kingbright, or it may be fabricated over the substrate 1401, using in-situ fabrication, for example, using printed electronics fabrication method. The alphanumeric display 1403*a* when constructed over the substrate 1401, may extend from the top surface of the substrate 1401 to the top surface 1408 of the trading card 1400. For example, the portion 1403*b* of the alphanumeric display 1403*a* may be disposed on the top surface of the substrate 1401.

Similarly, the touch button 1404*a* may be implemented as discrete components or fabricated in-situ, over the substrate, for example, using printed electronics technology. The touch button 1404*a* when constructed over the substrate 1401 may extend from the top surface of the substrate 1401 to the top surface 1408 of the trading card 1400. For example, the portion 1404*b* of the touch button 1404*a* may be disposed on the top surface of the substrate 1401.

The built in antenna 1405 as described in the data sheets of the Texas instruments part CC2420 may be disposed on the substrate.

The LEDs 1406*a* may be a discrete component such as LTST-C190CKT from the manufacturer Liteon or fabricated in-situ over the substrate 1401, for example, using printed electronics technology. In one embodiment, the LEDs 1406*a* may be organic light emitting diodes, as previously described. The LEDs 1406*a* when constructed over the substrate 1401, may extend from the top surface of the substrate 1401 to the top surface 1408 of the trading card 1400. For example, the portion 1406*b* of the LEDs 1406*a* may be disposed on the top surface of the substrate 1401.

Additionally, the capacitive touch slider 1407*a* may be a separate component formed of two indium transparent films separated by a dielectric, or fabricated in-situ over the substrate 1401, for example, using printed electronics technology. The touch slider 1407*a* when constructed over the substrate 1401 may extend from the top surface of the substrate 1401 to the top surface 1408 of the trading card 1400. For example, the portion 1407*b* of the touch slider 1407*a* may be disposed on the top surface of the substrate 1401.

Figure 15:
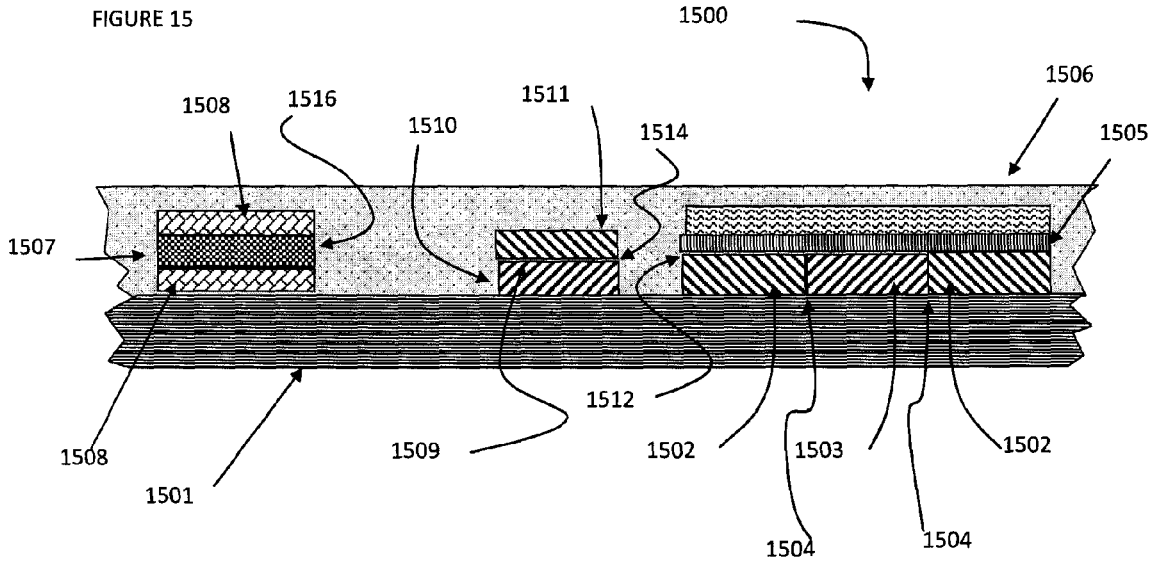
FIG. 15 is a diagram illustrating in greater detail exemplary construction of electronic components on a substrate utilizing print technology.

FIG. 15 is a diagram illustrating in greater detail exemplary construction of some electronic components on a substrate utilizing print technology. More specifically, FIG. 15 shows a cross section of the substrate 1501, with various sub-layers fabricated over the substrate 1501 to form some components of an trading card 1500. The sub-layers may be deposited using print technology. The substrate 1501 may be of the commonly known type FR4, or high temperature thick film of Kapton material, or other suitable organic substrates, for example, Mylar or Duralar plastic substrates.

An exemplary transistor 1512 may be formed over the substrate 1501, by using a plurality of sub-layers, which may be appropriately doped to function as a p-type or a N-type semiconductor. For example, the sub-layers 1502, 1503 may form N-type and P-Type semiconductor material respectively. The sub-layers 1502 and 1503 may be of organic film types as described in U.S. Pat. No. 5,629,530 and U.S. Pat. No. 6,869,699, and incorporated herein by reference. The sub-assembly formed by sub-layers 1502, 1503, 1502 at junction 1504 form a P-N Junction. A sub-layer 1505 deposited over the sub-layers 1502 and 1503 may act as an insulating polymer gate and a sub-layer 1506 deposited over the sub-layer 1505 may act as a conducting gate. As one skilled in the art appreciates, such a structure would behave as a transistor.

Similarly, a light emitting diode 1514 may be fabricated over the substrate 1501. For example, sub-layer 1510 is formed over the substrate 1501. Then, a sub-layer 1511 is formed over the sub-layer 1510. The sub-layer 1510 and 1511 may be of P-type and N-type semiconductor layers and the junction between the sub-layers 1510 and 1511 may define a P-N junction 1509, thereby constructing a light emitting diode.

An exemplary touch sensitive capacitor 1516 may be formed over the substrate 1501. A metallization sub-layer 1508 is formed over the substrate 1501. Then, a dielectric sub-layer 1507 is formed over the metallization sub-layer 1508. Then, another metallization sub-layer 1508 is formed over the dielectric sub-layer. The dielectric sub-later 1507 sandwiched between metallization sub-layers 1508 form a touch sensitive capacitor.

It should be noted that since the substrate 1501 may be of the printed circuit board type, additional discrete components may also be operationally coupled to the substrate 1501. Finally circuits fabricated over the substrate 1501 and other components coupled to the substrate may be encased in a protective layer 1506.

Figure 16:
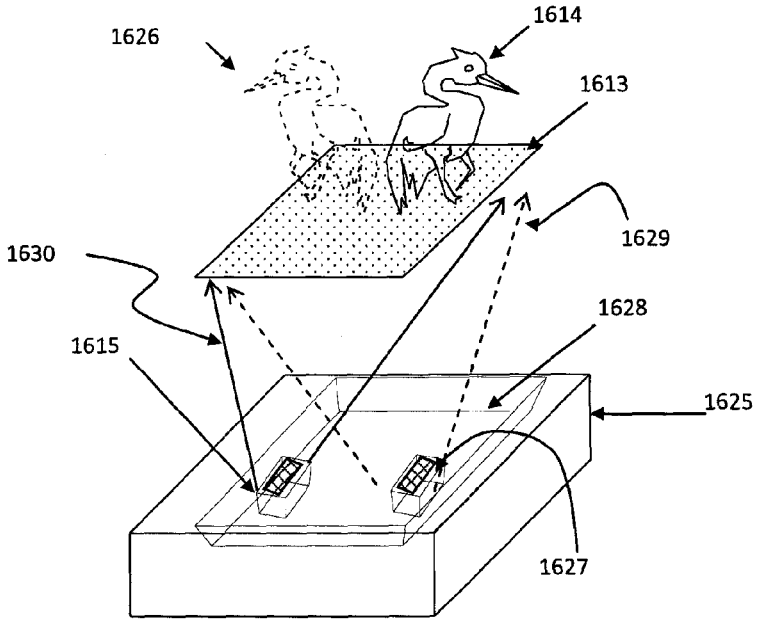
FIG. 16 is a diagram illustrating a holographic display incorporated in an exemplary trading card of the present disclosure with representative holographic projected images in action for illustrative purposes.

FIG. 16 is a diagram illustrating a holographic display incorporated in an exemplary trading card of the present disclosure with representative holographic projected images. For ease of description, a trading card 1625 is shown in FIG. 16, with only portions of components related to the holographic display. The hologram may be a transmissive hologram with two light emitting devices generating reference beams to project the embedded image during operation. The trading card 1625 includes a cavity 1628 to receive reference beam source 1615 and 1627. A transmission hologram 1613 is configured to cover the cavity 1628.

Holograms are generated by the reference and incident light forming interference patters in a recording medium, For example, referring to FIG. 16, the transmission hologram 1613 may be configured to have multiple images recorded, each with a different reference beam angle. The reference bean sources 1615 and 1627 may each be configured to generate a plurality of reference beams. For example, the transmission hologram 1613 would reproduce their recorded images, with the exposure of reference beams 1629 and 1630 at the original recording angles.

Therefore, the two reference beam sources 1615 and 1627 would generate reference beams 1630 and 1629 to generate two holographic images 1626 and 1614 respectively. If the generation of multiples images is controlled at a speed more than the persistence of vision of the human eye, the images are perceived to be moving or animated.

Having described various exemplary construction of trading cards, exemplary description of operation of the trading cards will now be described.

Description of Operation

Figure 17:
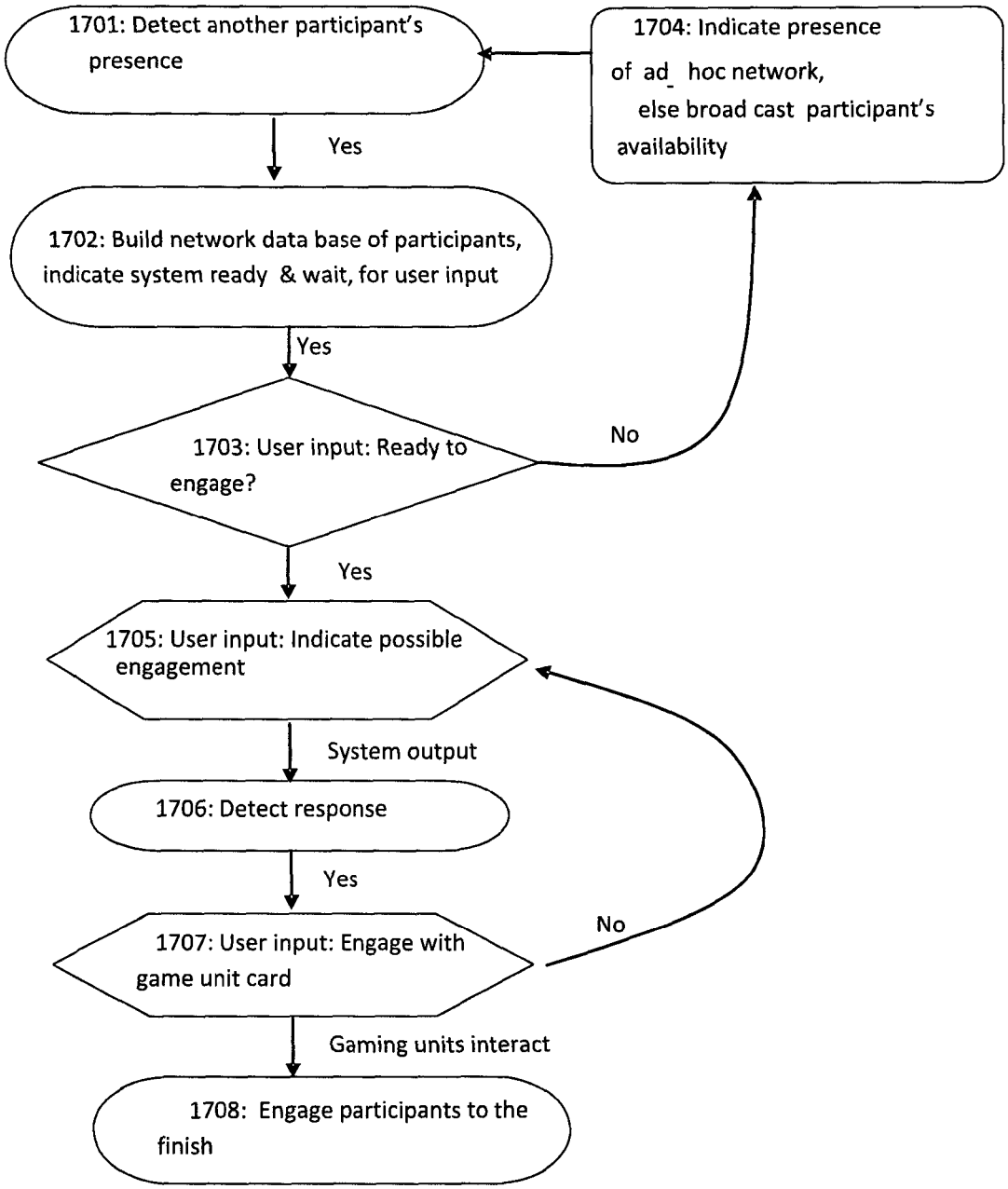
FIG. 17 is a system level flow chart summarizing the steps of interactive operation of exemplary trading card of the present disclosure.

FIG. 17 shows a system level flow chart summarizing exemplary steps of interactive operation of exemplary trading card of the present disclosure. In one embodiment, the trading card is energized and waiting for an external event, at step 1701. The external event may be participant's input or a wireless message reception, or detection of another wireless network in the vicinity, as shown in step 1704.

In one embodiment, the trading card is periodically transmitting availability of the trading card to the general vicinity of the trading card. The transmission of the presence and receipt of signals may be periodically performed. For example, the transmission of the presence and receipt of signals may be performed once in 5 minutes, or 10 minutes, based on system designer's specifications on energy conservation of the system and other parameters such as frequency of detecting other networks, or even based on geographical location detected by the peripheral inputs from a global positioning system.

Once the trading card detects the presence of an external wireless network, the processing engine of the trading card at step 1702, proceeds to build a local database which would contain the available participants in the network. Then at step 1703, the processing engine of the trading card, presumably having indicated the presence of one of the triggering events as described above, waits for the participant's input to continue to engage other participant(s) in a game. The participant, at step 1705, may negotiate rules of the current engagement, such as wagering a card or other resource to the opponent(s) and await the response, at step 1706.

At the reception of a response, at step 1707, from the opponent(s), the current participant continues engagement in the game with the opponent. The trading card of the participant communicates with the trading card of the opponent as the participant and the opponent provide inputs to their trading cards. Eventually, the game ends in step 1708.

As one skilled in the art appreciates, the present trading card of the present disclosure enables a social interaction within the framework of an ad-hoc wireless gaming system.

Figure 18:
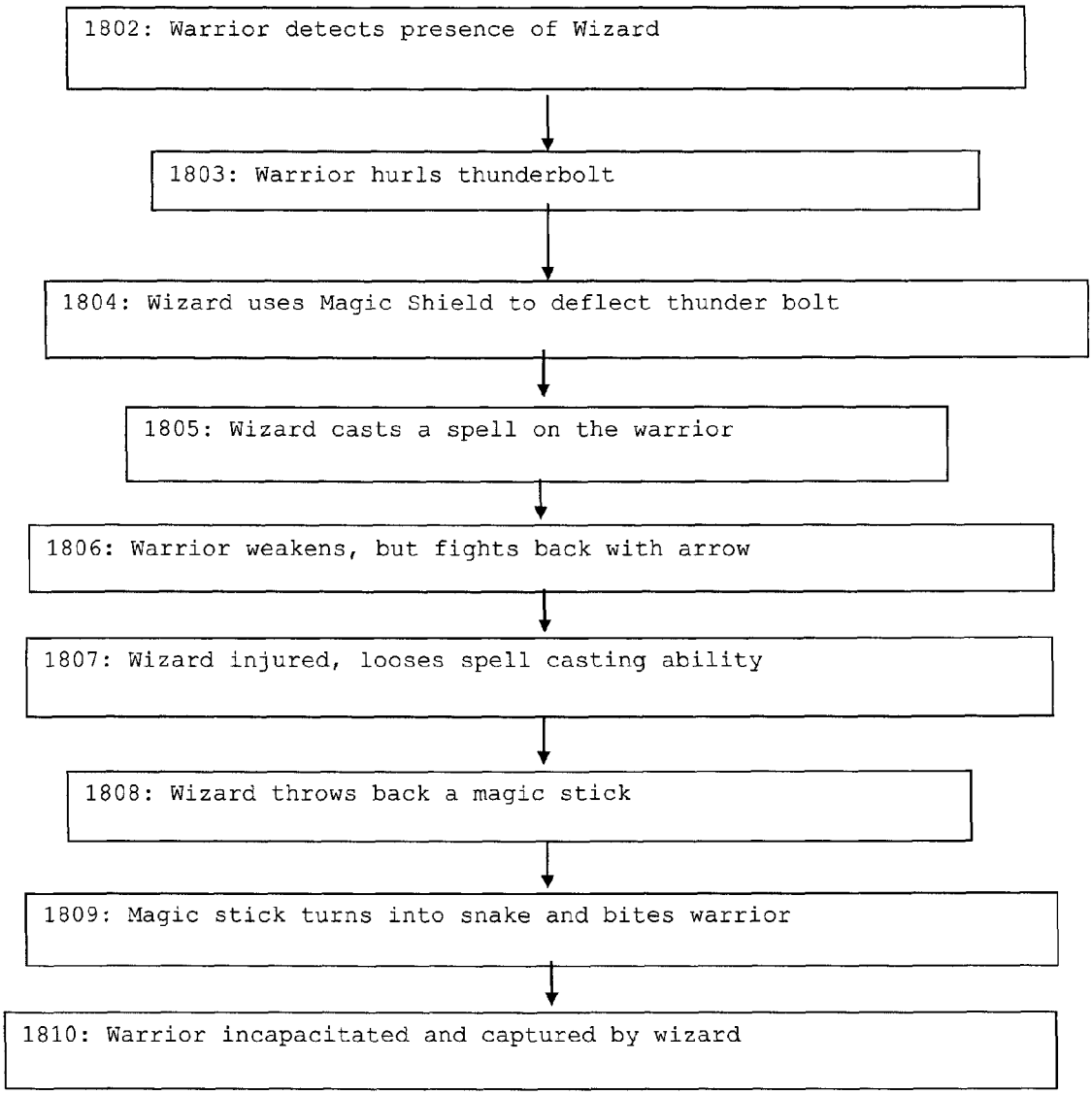
FIG. 18 is a diagram illustrating overview of an exemplary game involving Warriors, Wizards, and Magic for use with exemplary trading cards of this disclosure.

Now, referring to FIG. 18 an exemplary game involving Warriors, Wizards, and Magic played with an exemplary trading cards of this disclosure is described. In the exemplary game, there are two participants with each participant using an trading card of this disclosure. For convenience, two participants are referred to as current participant and the opponent participant. However, those skilled in the art may recognize that the description does not restrict the present disclosure to only two players.

The exemplary game has a warrior and a wizard as characters. One of the trading card, for example, a first trading card may be configured as a warrior trading card and another trading card, for example, a second trading card may be configured as a wizard trading card. The warrior trading card has certain capabilities. These capabilities may be characteristic of a warrior. For example, hurling a thunderbolt, arrow etc. The wizard trading card has certain capabilities. These capabilities may be characteristic of a wizard. For example, these capabilities may be casting a spell, throwing a magic stick etc. One of the participants will use the warrior trading card and one of the participants will use the wizard trading card.

The warrior trading card and wizard trading card may be part of a social network, as previously described with reference to FIG. 17.

Initially, the warrior trading card recognizes the presence of the wizard trading card in the network in step 1802. The display on the warrior trading card may be configured to display the presence of a wizard trading card, within the vicinity of the warrior active gaming card. The participant holding the warrior trading card may then initiate the game by giving a command to the warrior trading card.

For example, the participant provides inputs to the warrior trading card to deploy a weapon such as a thunderbolt, which may be part of the warrior's arsenal, to strike the wizard at step 1803. In one embodiment, the inputs provided at step 1803 may be in form of (a) press a button "S," for example, on the gaming unit to "Set" the weapon, (b) press "R" to indicate which weapon, once or twice or n-times based on the gaming rule implemented, (c) using the slider bars implemented in the surface of the gaming unit to indicate the strength of the weapon to be hurled at the opponent, (d) followed by pressing the "P" play button.

The processing engine of the warrior trading card receives all these inputs and assembles them into a message to be transmitted, adding the current participant's identification which may be in the form of a unique identification of the warrior trading card, opponent's identification, in this case, the unique identification of the wizard trading card, and the parameters of the warrior trading card's challenge to the opponent and transmits the message. The message may be transmitted wirelessly. In some embodiments, the transmitted message may contain an audio content as well.

In one embodiment, the game attributes of the warrior trading card is modified to reflect the use of thunderbolt. This may be done by modifying the value of thunderbolt attribute in the personality module of the warrior trading card.

The wizard trading card receives the transmitted message and indicates the threat received. For example, the threat received may be displayed on the display unit of the wizard trading card. The participant using the wizard trading card would provide inputs to the wizard trading card to deploy a shield, also part of the repertoire of the wizard's ensemble at step 1804.

In one embodiment, the game attributes of the wizard trading card is modified to reflect the use of the shield. This may be done by modifying the value of shield attribute in the personality module of the wizard trading card.

For example, availability of a shield for deployment as an attribute of the wizard trading card may be stored in the personality module of wizard trading card. As previously discussed, the attributes of the trading card may be initially set or a participant may later add or modify the attributes.

In step 1805, the participant with the wizard trading card provides command to the trading card to cast a spell on the warrior. Various input devices in the trading card may be used to set the parameters to cast a spell on the warrior trading card. Then, the processing engine in the wizard trading card assembles a message to be transmitted back to the warrior trading card, with the contents of the message including the wizards's identification, warrior's's identification and other parameters of the gaming units response, and transmits the message. The message may be transmitted wirelessly.

In step 1806 the warrior trading card receives the message from the wizard trading card. The processing engine of the warrior trading card processes the message according to the rules of the game, and indicates to the current participant, that the wizard trading card's spell has reduced the strength of the warrior trading card. This may be indicated to the participant by showing less intensity of LEDs or, by turning off some of the LEDs that are indicators of the property of the trading card. Thus the processing engine of the trading card communicates the trading card's status to the participant.

In one embodiment, such status indicator LEDs may be arranged and assembled in the trading card to conform to the artwork on the surface of the trading card that intuitively suggest the status of the trading card's strength or other such properties to the participant.

In step 1806, the participant using the warrior trading card decides to use a different weapon, such as a bow and an arrow, also a part of the warrior trading card's arsenal of weapons, by utilizing buttons as described previously and further engages the opponent by pressing the aforementioned "P" button, so as to send a message to the wizard trading card.

In step 1807, the wizard trading card receives the message from the warrior trading card. The processing engine in the wizard trading card processes the received message and determines that the wizard trading card looses one of the properties such as casting spells. This may be displayed using one of the display units in the wizard trading card.

In step 1808, the participant holding the wizard trading card decides to utilize another weapon in the wizard trading card's repertoire and hurls a magic stick. A message indicating the hurling of a magic stick is broadcast, as previously described.

In step 1809, the message indicating the hurling of the magic stick is received by the warrior trading card. In the step 1809, the warrior trading card analyzes the message received from the wizard trading card and determines, according to the gaming rules, that the warrior trading card gets bitten by the magic stick turning into a snake. In step 1801, this reaction incapacitates the warrior trading card. The warrior trading card may be configured to display the status of the trading card to the participant, using one or more of the display mechanisms.

In some embodiment, according to gaming rules the participant with the warrior trading card looses the battle. In some embodiments, the participant surrenders the warrior trading card to the participant using the wizard trading card. This would conclude one session of the game. However, the game itself may then proceed with the participant utilizing another trading card as taught by the present disclosure.

Figure 19A:
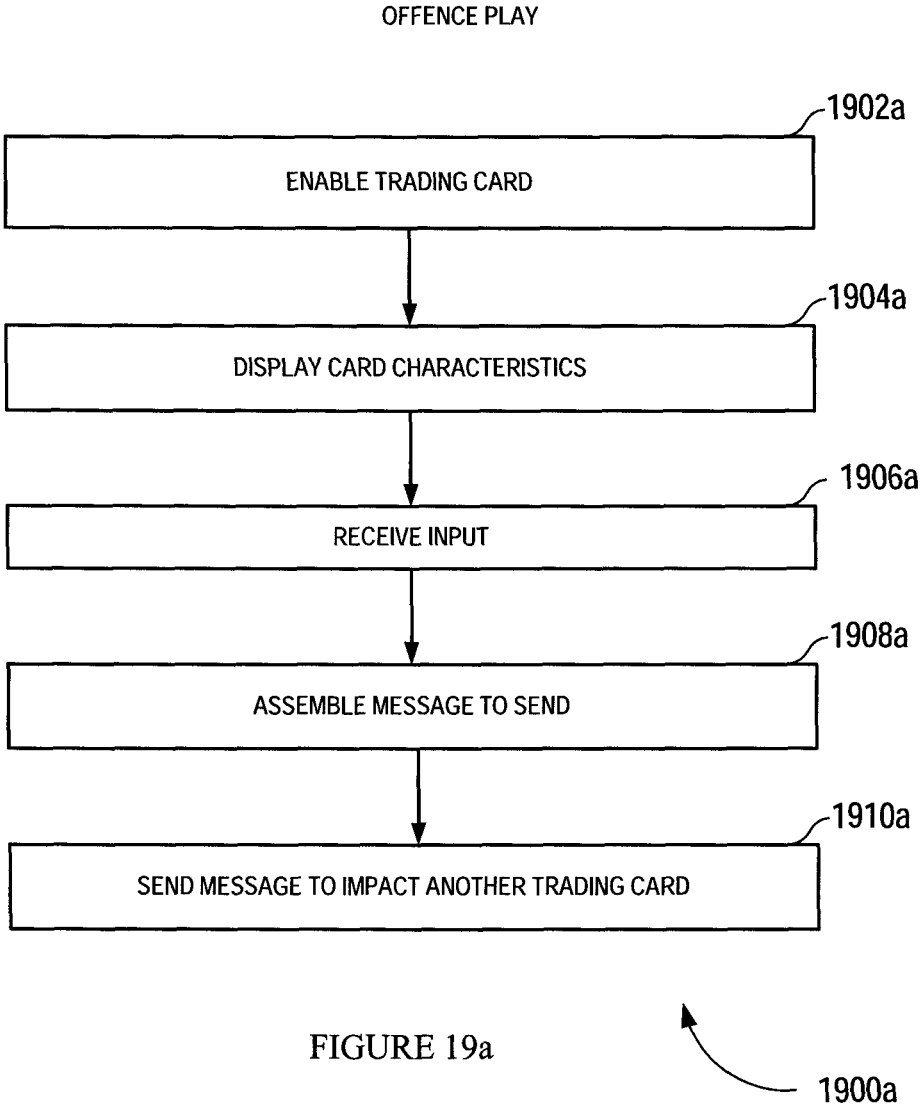
FIGS. 19*a* and 19*b* show exemplary steps performed in a trading card to perform two exemplary plays.
Figure 19B:
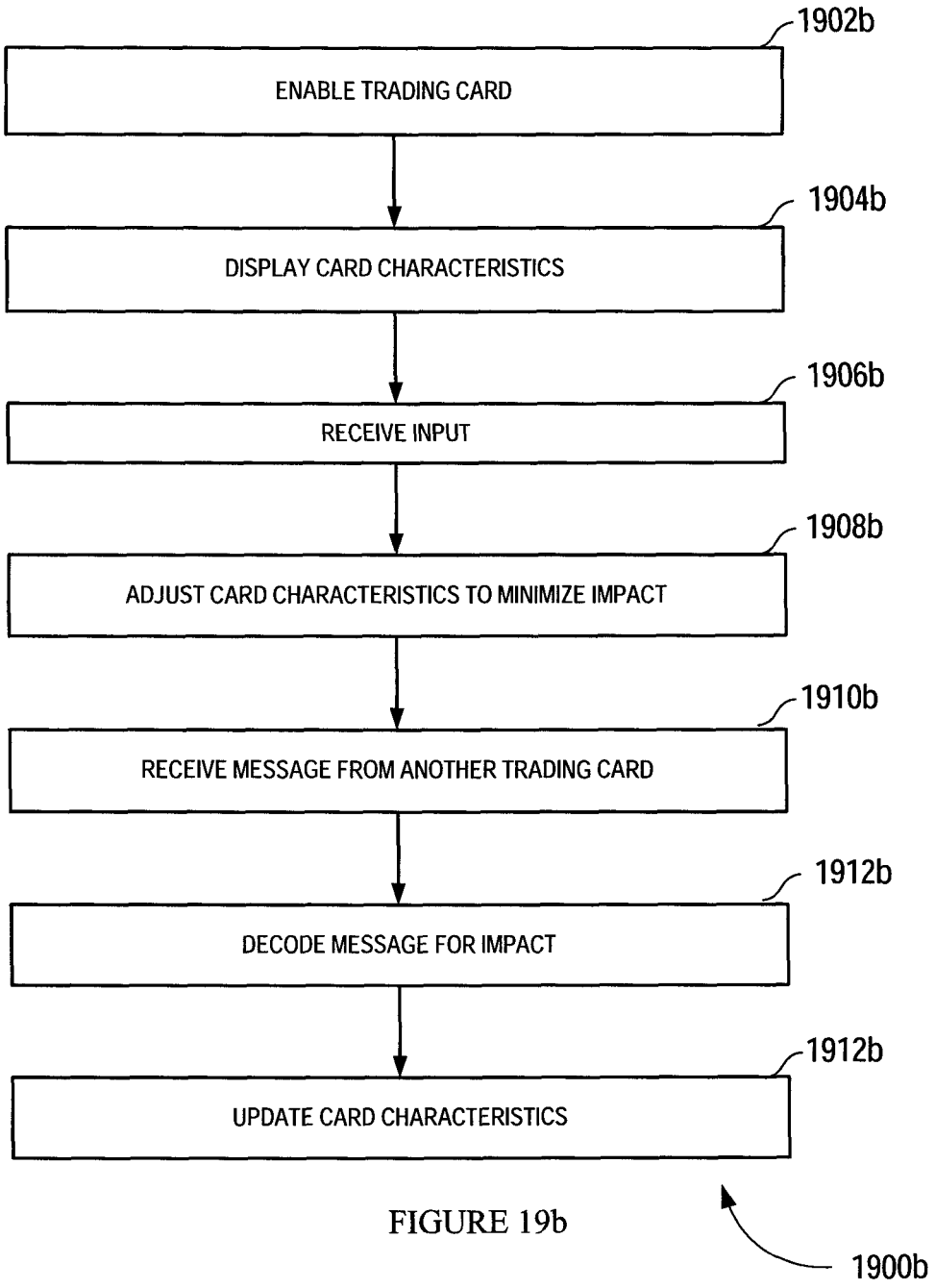

FIGS. 19*a* and 19*b* show exemplary steps performed in a trading card to perform two exemplary plays. FIG. 19*a* illustrates exemplary steps utilized in an trading card that is performing an offensive play. FIG. 19*b* illustrates exemplary steps utilized in a trading card that is performing a defensive play.

Now referring to FIG. 19*a*, exemplary steps utilized in a trading card that is performing an offensive play is described.

In step 1902*a*, the trading card is enabled. In one embodiment, the trading card may be always enabled. In one embodiment, the trading card is enabled using an external input, for example, an action by a user.

In step 1904*a*, the trading card characteristics are displayed. This may include displaying various attributes of the trading cards like strength, speed, sting, venom, shield, magic and agility. In one embodiment, the trading card might have recognized the presence of other trading cards, as previously described and displays the availability of other trading cards to initiate a game.

In step 1906*a*, the trading card receives an input. In one embodiment, the input may be audio input provided by a user, using the microphone of the trading card. In one embodiment, the audio input may be preceded or succeeded by other inputs received from the user interface of the trading card, for example, the switches. One of the inputs may be to instruct the trading card to assemble a message.

In step 1908*a*, the trading card assembles the message to send. In some embodiments, the message assembled may include audio message with additional control messages. The audio message may be configured to be reproducible in another trading card that receives the message.

In step 1910*a*, the message is sent to impact another trading card. In some embodiments, the message may only include an audio message. In some embodiments, the message may include control message that is configured to attack or impact another trading card. In some embodiments, the message may include both audio message and control message.

Now referring to FIG. 19*b*, exemplary steps utilized in an trading card that is performing a defensive play is described.

In step 1902*b*, the trading card is enabled. In one embodiment, the trading card may be always enabled. In one embodiment, the trading card is enabled using an external input, for example, an action by a user.

In step 1904*b*, the trading card characteristics are displayed. This may include displaying various attributes of the trading cards like, strength, speed, sting, venom, shield, magic and agility. In one embodiment, the trading card might have recognized the presence of other trading cards, as previously described and displays the availability of other trading cards to initiate a game. In one embodiment, the trading card may display an imminent threat from another trading card.

In step 1906*a*, the trading card receives an input. In one embodiment, the input may be to configure or reconfigure the trading card to defend against an imminent threat. In one embodiment, the input may be received from the user interface of the trading card, for example, the switches. One of the inputs may be to instruct the trading card to deploy some shields or the like to minimize the impact of an imminent threat.

In step 1908*b*, the trading card adjusts the card characteristics to minimize the impact.

In step 1910*b*, the message is received from the other trading card. This message may be intended to impact the trading card. In some embodiments, the message may only include an audio message. In some embodiments, the message may include control message that is configured to attack or impact the trading card. In some embodiments, the message may include both audio message and control message.

In step 1912*b*, the message is decoded to determine the impact to the trading card.

In step 1912*b*, the trading card characteristics are updated based upon the impact of the message on the trading card. This may include updating various attributes of the trading cards like strength, speed, sting, venom, shield, magic and agility.

Figure 19C:
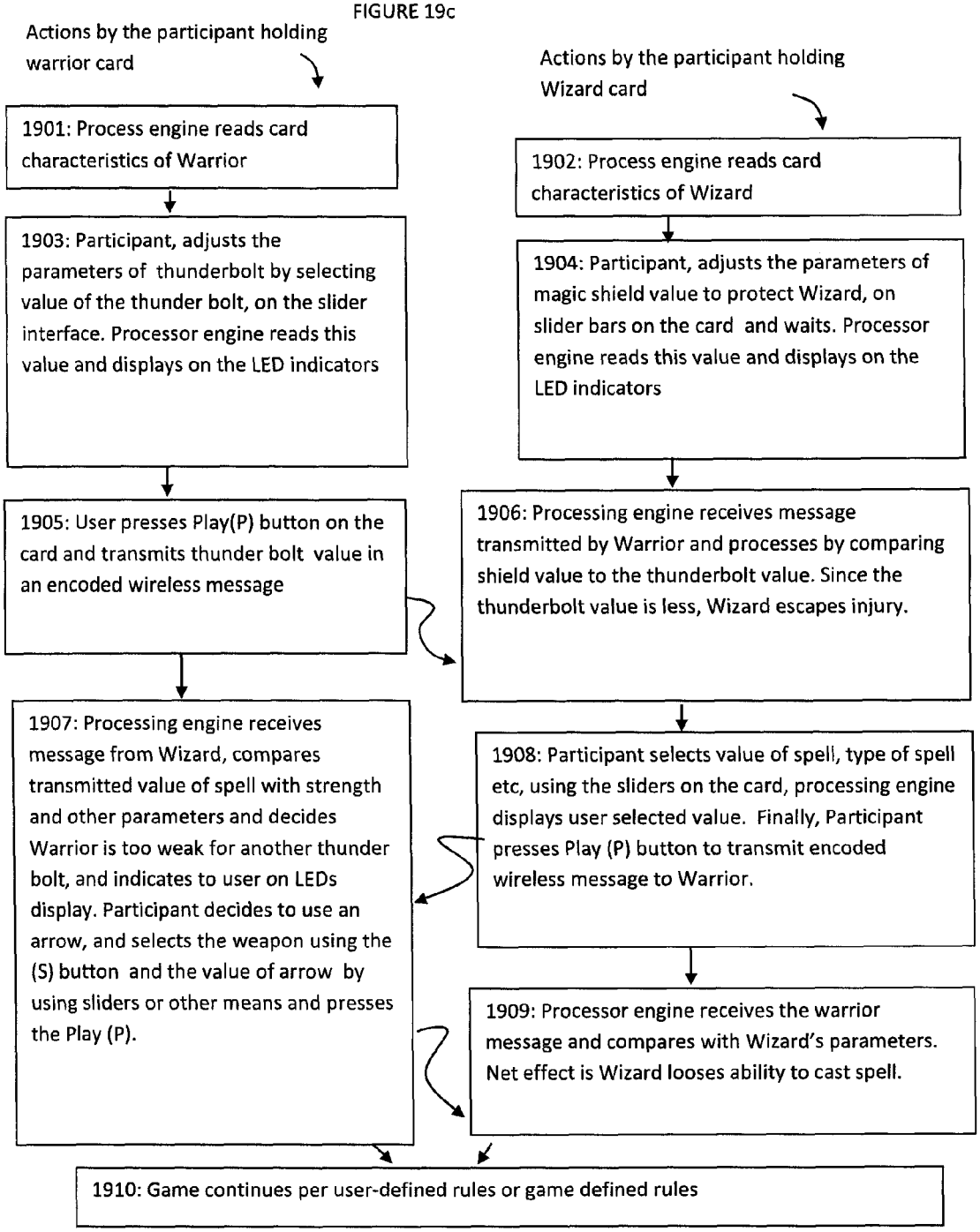
FIG. 19*c* is a diagram illustrating in greater detail exemplary steps utilized in a pair of trading cards to play exemplary game outlined in FIG. 18.

FIG. 19*c* is a diagram illustrating exemplary steps utilized in a pair of trading cards to play exemplary game outlined in FIG. 18. In one embodiment, the trading cards may utilize the exemplary process steps described with reference to FIGS. 19*a* and 19*b*, as part of playing an offensive play and a defensive play respectively.

The FIG. 19*c* illustrates an exemplary steps utilized with a pair of trading cards to play exemplary game outlined in FIG. 18. For example, the steps 1901, 1903, 1905 and 1907 are related to the trading card configured as a warrior. The steps 1902, 1904, 1906, 1908 and 1909 are related to the trading card configured as a wizard. FIG. 19 only depicts a part of the gaming interactivity shown in FIG. 18 and concludes with step 1910, indicating that the game continues per game rules.

The warrior trading card and the wizard trading card may be constructed as previously described with reference to FIG. 2 and FIG. 3. The participant utilizing the warrior trading card is referred to as warrior player and the participant utilizing the wizard trading card is referred to as wizard player.

In step 1901, the warrior trading card is enabled. For example, the warrior trading card may be enabled by pressing the "Q" button, or a combination of the buttons "P", "Q", "R", & "S", buttons on the warrior trading card. In one embodiment, the processing engine of warrior trading card reads the card characteristics.

Then in the step 1903, the thunderbolt parameters of the warrior trading card is adjusted. In one example, the thunderbolt parameter is adjusted by utilizing the "S" button to inform the processing engine, that the warrior player is inputting the value of one of the weapons. Following this the warrior player, in the same step, may use the sliders to input a value into the processor engine and may conclude the input process by pressing the "S" button again.

Based on the gaming instructions implemented in the processing engine's instructions memory, it is apparent to those well versed in the art that four buttons present 16 combinations, and adding temporal variability of pressing the same buttons, there may be many more such combinations provided to the processing engine.

The processing engine then interprets the inputs per the gaming instructions in the processing engine's instructions in the instruction memory and outputs a status to the warrior trading card by turning on certain LEDs, for example, LEDs outlining the artwork, such that the warrior player interprets the associated property and attributes of the warrior trading card. For example, these attributes may be available from the personality module of the trading card.

Then, in step 1905, the warrior player presses the "P" button to inform the processing engine to assemble a message containing the warrior trading card identification, the intended opponent's identification, for example, the wizard playing card identification plus any other trading card's characteristics, such as identification that the message originates as a warrior with properties such as strength, agility, etc. Further the processing engine transmits the message to the wizard trading card after the message is assembled.

Now referring to the steps related to the wizard trading card, in step 1902, the wizard trading card is enabled.

In step 1904, the wizard trading card, being aware of engaging in a battle with the warrior trading card, adjusts the wizard's parameters such as shielding of the wizard as a preparation for the imminent battle. In one embodiment, the processing engine indicates the strength of the shield and other such abilities by turning on LEDs on the wizard trading card. Thus the wizard trading card and the wizard player are now ready to further engage in the battle with the warrior trading card and the warrior player.

The step 1906, the wizard trading card receives the message transmitted by the warrior trading card and processes the received message. As an example, if the value of the thunderbolt in the warrior trading card was set to be 128 units, and the value of the shield in the wizard trading card was set to be 130 units, the processing engine compares the two numbers and indicates that the warrior trading card's thunderbolt took away 128 units of shielding of the wizard trading card, such that the wizard trading card is now weakened. However no harm befalls the wizard gaming unit, since there is still some shielding left. Thus, the present disclosure teaches, how the message contents may be utilized in a game.

In the step 1908, the wizard player selects a value for the spell on the wizard trading card to be cast on the warrior trading card. In one embodiment, the value for the spell may be selected by using the slider inputs. In addition, a verbal exclamation may be recorded and included in the message to be transmitted to the warrior trading card. The verbal or audio message may be added by utilizing the audio accessories and analog to digital converters and other buttons or combination of buttons in the wizard trading card, and presses the "P" or play button. The processing engine then assembles a message to be transmitted, which includes the sender's identification, the recipient's identification, and other message contents (including for example, audio message) and transmits it to the warrior trading card.

In the step 1907, the warrior trading card receives the message from the wizard trading card. The processing engine of the warrior trading card then processes the message by reproducing the embedded audio in the message, utilizing the digital to analog converter, and by comparing the strength of the spell to the strength of the warrior. In one embodiment, the processing engine then determines that the warrior is too weak to use another thunderbolt. The processing engine indicates this status to the warrior player, by turning more LEDs on the gaming unit to an off state.

The warrior player then decides to utilize a different weapon. The warrior player may select different weapon, for example, an arrow, by utilizing the "S" button or a combination of buttons on the gaming unit. The warrior player may further select the strength of the arrow etc, and instructs the processing engine to continue the battle by pressing the "P" or play button.

Then in the step 1907, the processing engine of the warrior trading card transmits the assembled message to the wizard trading card.

In step 1909, the wizard trading card receives this message and compares the received message to the wizard's abilities and decides, based on gaming rules, that the wizard looses the ability to cast spells.

Then the game continues in step 1910, based on the gaming rules established by the manufacturer of the gaming units, or as modified by the participants. It should now be evident to those versed in the art that the above description is one of the many possible scenarios that the present disclosure teaches. The communication between the trading cards may be wireless. In some embodiments, the communication between the trading cards may be based on a ad-hoc wireless network. Finally exemplary method of temporal multi-hop message transmission and reception is described with reference to FIG. 20.

Figure 20:
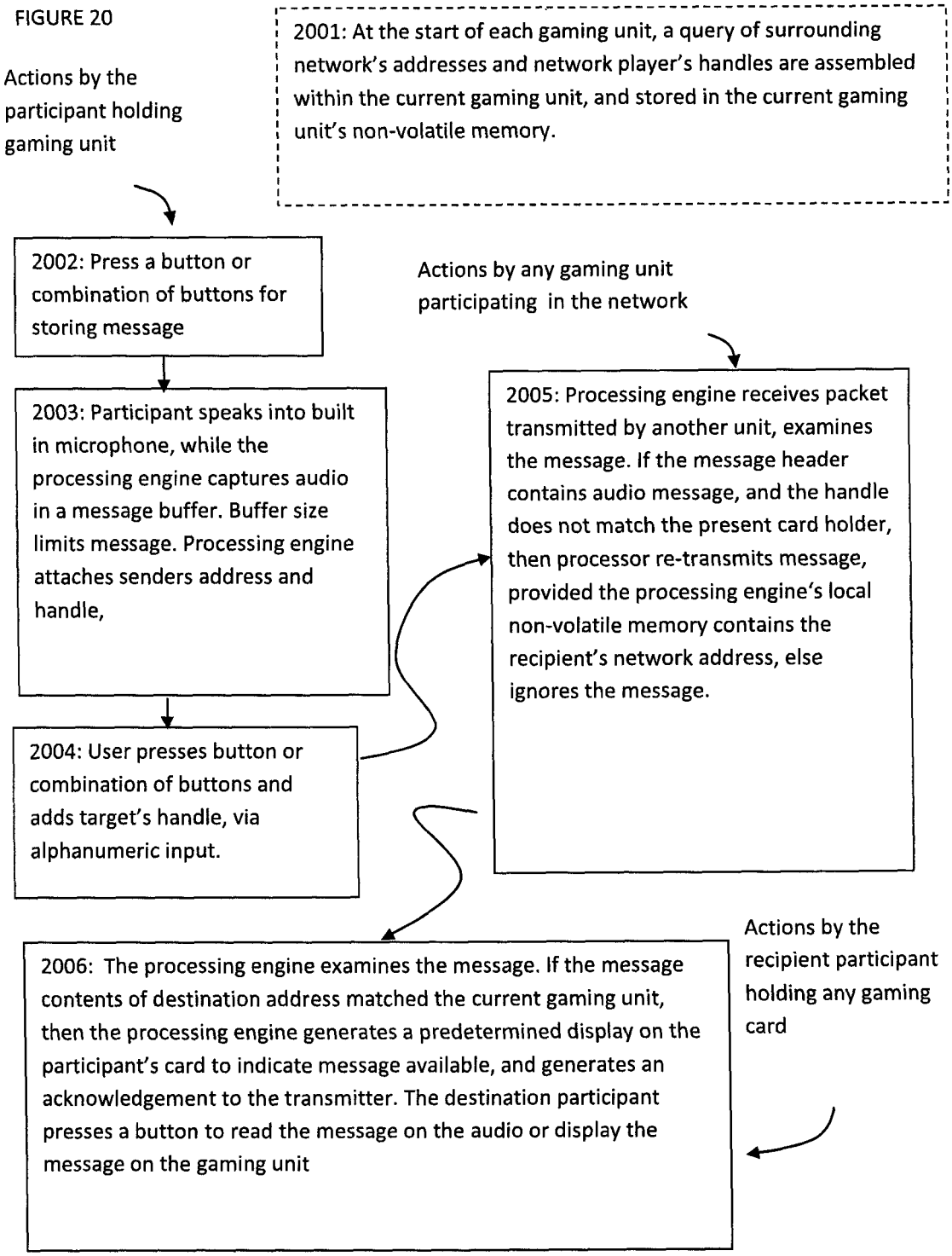
FIG. 20 is a diagram illustrating in greater detail exemplary steps utilized in operating a plurality of trading cards in an exemplary multi-hop messaging environment.

FIG. 20 is a diagram illustrating exemplary steps utilized in operating a plurality of trading cards in an exemplary multi-hop messaging environment. The term temporal messaging here means that any message transmission and reception may be immediate or spread over space and time, depending on the availability of gaming units that are within or without the communicable range of the current gaming unit.

In step 2001, the gaming unit builds a database of the local area environment. As mentioned in the description of FIG. 17, at the beginning of any game unit activation, the gaming unit builds a database of the local area environment. In one embodiment, a trading card transmits message indicating its presence in the vicinity and waits for a response from any other trading card that is within a communicable range. In one embodiment, the networks' addresses are also assigned such as the one implemented by the IEEE standard 802.15.4 or any similar network protocols.

Then, the processing engine of a trading card analyzes the received messages and stores the identifier handles of other trading cards recognized and their associated network addresses in its memory. Such network data base may be accumulated into a flash memory unit.

In one embodiment, as part of house keeping operation of a gaming unit's processing engine's tasks, the processing engine may prune the database as generally known as the "LRU" (least recently used) algorithms or any similar algorithms. Thus the "state" of the network is available to the current gaming unit as and when required by the processing engine.

Referring to the step 2002, FIG. 20, the current participant presses a button, for example "Q" or a combination of the available buttons, to start the message recording.

In step 2003, the participant may provide audio input, for example, by speaking into the microphone of the trading card.

In step 2004, the participant may input a destination handle by inputting alphanumeric data based on numbers generated by the sliders and interpreted by the processing engines instruction set in the gaming unit's instruction memory. In one embodiment, when the message is ready, it may be indicated by an LED on the gaming unit. The current participant presses a button, for example the "P" play button, to transmit the message.

In step 2005, any other gaming unit may receive the recently transmitted message in step 2004. Based on a LRU algorithm, the gaming unit will look up it's database and decide on whether the message will be retransmitted or not.

Referring to step 2006 of FIG. 20, when the message reaches the intended destination, the processing engine of the destination trading card examines the message. If the destination address in the message matches the destination trading card's handle, then the processing engine generates a predetermined display on the destination trading card to indicate that there is a message available. In some embodiments, the destination trading card may generate an acknowledgement to the trading card that transmitted the message. The acknowledgement of the received message returns to the originator via similar multi-hop means.

The destination participant presses a button to listen to the message on the audio reproducing device or to display and read the message on the trading card.

Although this disclosure discloses various embodiments of trading cards, in these embodiments, depending upon the game played and rules of the game, it is not necessary that the trading cards of this disclosure are traded or exchanged as part playing the game.

While the present invention has been described in particular embodiments, the present invention should not be construed as limited by such embodiments, but rather construed according to the below claims.

What is claimed is:

1. A game system, comprising:

at least a first trading card and a second trading card, with the first trading card and the second trading card including:

a substrate;

a plurality of light emitting devices disposed over the substrate;

a processing engine; and a wireless interface configured to communicate with the other trading card;

wherein, the first trading card and the second trading card are each configured with a plurality of capabilities;

wherein, the first trading card and the second trading card are each configured to detect the presence of the other trading card using the wireless interface;

wherein, the first trading card initiates a game with the second trading card after detecting the presence of the second trading card, selects a capability indicative of an attack and sends a message indicative of the selected attack to impact the second trading card;

wherein the first trading card and the second trading card further including a hologram light emitting device disposed over the substrate; and a holographic display operatively disposed over the hologram light emitting device, the hologram light emitting device is selectively energized to project a hologram.

2. The game system of claim 1, wherein the second trading card receives the message indicative of the selected attack sent from the first trading card and initiates an action to counter the impact of the selected attack.

3. The game system of claim 2, wherein a subset of the plurality of light emitting devices are modified to display the impact of the message from the first trading card.

4. The game system of claim 3, wherein the first trading card and the second trading card further including:

an audio output device to reproduce audio signals; and an audio input device to receive audio input;

wherein, the message sent from the first trading card includes an audio portion received through a microphone of the first trading card and the second trading card reproduces the audio portion of the message using a speaker of the second trading card.

5. The game system of claim 2, wherein the first trading card and the second trading card further including a personality module to store one or more attributes of the first trading card and the second trading card, wherein one or more attributes of the first trading card are modified based upon the message sent to the second trading card; and wherein one or more attributes of the second trading card are modified based upon the impact of the message from the first trading card.

6. The game system of claim 5, wherein at least one of the attribute indicative of a capability of the trading card and a value associated with the capability stored in the personality module, the value associated with the capability indicative of the strength of the capability.

7. The game system of claim 6, wherein a subset of the plurality of light emitting devices is configured to display the strength of the capability.

8. The game system of claim 1, wherein an artwork disposed over a surface of the first trading card and the second trading card; and the plurality of light emitting devices spatially arranged with respect to the artwork to provide an outline for portions of the artwork.

9. The game system of claim 1, wherein at least the substrate of one of the first trading card and the second trading card configured to removably couple to a base unit to form a gaming unit; and one or more of the processing engine and the wireless interface disposed within the base unit.

10. The game system of claim 1, wherein at least one of the first trading card and the second trading card further including an energy harvester to generate electric charge for use by the trading card.

11. A game system, comprising:

at least a first trading card and a second trading card, with the first trading card and the second trading card including:

a substrate;

a plurality of light emitting devices disposed over the substrate;

a processing engine; and a wireless interface configured to communicate with the other trading card;

wherein, the first trading card and the second trading card are each configured to detect the presence of the other trading card using the wireless interface;

wherein, the first trading card initiates a game with the second trading card after detecting the presence of the second trading card and sends a message to impact the second trading card, wherein the first trading card and the second trading card further including a hologram light emitting device disposed over the substrate; and a holographic display operatively disposed over the hologram light emitting device, the hologram light emitting device is selectively energized to project a hologram.

12. The game system of claim 11, wherein the second trading card receives the message indicative of a selected attack sent from the first trading card and initiates an action to counter the impact of the selected attack.

13. The game system of claim 12, wherein a subset of the plurality of light emitting devices are modified to display the impact of the message from the first trading card.

14. The game system of claim 13, wherein the first trading card and the second trading card further including:

an audio output device to reproduce audio signals; and an audio input device to receive audio input;

wherein, the message sent from the first trading card includes an audio portion received through a microphone of the first trading card and the second trading card reproduces the audio portion of the message using a speaker of the second trading card.

15. The game system of claim 12, wherein the first trading card and the second trading card further including a personality module to store one or more attributes of the first trading card and the second trading card, wherein one or more attributes of the first trading card are modified based upon the message sent to the second trading card; and wherein one or more attributes of the second trading card are modified based upon the impact of the message from the first trading card.

16. The game system of claim 15, wherein at least one of the attribute indicative of a capability of the trading card and a value associated with the capability stored in the personality module, the value associated with the capability indicative of the strength of the capability.

17. The game system of claim 16, wherein a subset of the plurality of light emitting devices is configured to display the strength of the capability.

18. The game system of claim 11, wherein an artwork disposed over a surface of the first trading card and the second trading card; and the plurality of light emitting devices spatially arranged with respect to the artwork to provide an outline for portions of the artwork.

19. The game system of claim 11, wherein at least the substrate of one of the first trading card and the second trading card configured to removably couple to a base unit to form a gaming unit; and one or more of the processing engine and the wireless interface disposed within the base unit.

20. The game system of claim 11, wherein at least one of the first trading card and the second trading card further including an energy harvester to generate electric charge for use by the trading card.

21. A method for interactive game system, comprising:

providing at least a first trading card and a second trading card, each trading card configured to communicate with the other trading card and configured to receive input;

displaying card characteristics of the first trading card and the second trading card;

receiving input in the first trading card to assemble a message;

assembling the message in the first trading card to send to the second trading card; and sending message to the second trading card to impact the second trading card, wherein the first trading card and the second trading card including a substrate, disposing a hologram light emitting device over the substrate;

operatively disposing a holographic display over the hologram light emitting device; and projecting a hologram by selectively energizing the hologram light emitting device.

22. The method of claim 21, wherein displaying card characteristics includes disposing one or more of a plurality of light emitting devices on the substrate of the first trading card and the second trading card; and selectively energizing one or more of the plurality of light emitting devices disposed over the first trading card and the second trading card.

23. The method of claim 22, further including adjusting card characteristics of the second trading card to minimize impact due to the message received from the first trading card;

receiving message from the first trading card;

decoding the message for impact to the second trading card; and updating card characteristics of the second trading card based upon impact from the message received from the first trading card.

24. The method of claim 21, wherein receiving input to assemble the message includes receiving an audio input.

* * * * *